US009830767B2

(12) United States Patent
Arnone et al.

(10) Patent No.: US 9,830,767 B2
(45) Date of Patent: Nov. 28, 2017

(54) GAME HISTORY VALIDATION FOR NETWORKED GAMBLING HYBRID GAMING SYSTEM

(71) Applicant: Gamblit Gaming, LLC, Glendale, CA (US)

(72) Inventors: Miles Arnone, Sherborn, MA (US); Frank Cire, Pasadena, CA (US); Clifford Kaylin, Los Angeles, CA (US); Scott Shimmin, Vista, CA (US); Eric Meyerhofer, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

(21) Appl. No.: 14/854,021

(22) Filed: Sep. 14, 2015

(65) Prior Publication Data

US 2016/0055712 A1 Feb. 25, 2016

Related U.S. Application Data

(63) Continuation of application No. PCT/US0214/022151, filed on Mar. 7, 2014.
(Continued)

(51) Int. Cl.
*G07F 17/32* (2006.01)

(52) U.S. Cl.
CPC ..... *G07F 17/3225* (2013.01); *G07F 17/32* (2013.01); *G07F 17/323* (2013.01);
(Continued)

(58) Field of Classification Search
CPC .... G07F 17/32; G07F 17/323; G07F 17/3241; G07F 17/3262; G07F 17/3286; G07F 17/3295; G07F 17/3225
(Continued)

(56) References Cited

U.S. PATENT DOCUMENTS 5,413,357 A 5/1995 Schulze et al.
5,718,429 A 2/1998 Keller
(Continued)

OTHER PUBLICATIONS

U.S. Appl. No. 14/586,645 Arnone, et al. filed Dec. 30, 2014.
(Continued)

*Primary Examiner* — David L Lewis
*Assistant Examiner* — Shauna-Kay Hall
(74) *Attorney, Agent, or Firm* — Caitlyn Ross

(57) ABSTRACT

A gambling hybrid game that provides game history validation is disclosed. The gambling hybrid game includes an entertainment system engine that provides an entertainment game to a user, a real world engine that provides gambling games to users, and a game world engine that monitors the entertainment game and provides gambling games when appropriate. The entertainment system engine stores game history information in response to a trigger event and provides at least a portion of the stored game history information to a game world engine. The game world engine stores received portion of the game history information. When a request for game history verification is received by the game world engine, the game world engine retrieves the game history information from the entertainment system engine and used the portion of the game history information stored by the game world engine to verify the game history information from the entertainment system engine.

24 Claims, 21 Drawing Sheets

Related U.S. Application Data

(60) Provisional application No. 61/783,585, filed on Mar. 14, 2013.

(52) U.S. Cl.
CPC ..... *G07F 17/3241* (2013.01); *G07F 17/3262* (2013.01); *G07F 17/3286* (2013.01); *G07F 17/3295* (2013.01)

(58) Field of Classification Search
USPC ..... 463/16, 25
See application file for complete search history.

(56) References Cited

U.S. PATENT DOCUMENTS 5,785,592 A 7/1998 Jacobsen
5,853,324 A 12/1998 Kami et al.
5,963,745 A 10/1999 Collins et al.
6,050,895 A 4/2000 Luciano
6,165,071 A 12/2000 Weiss
6,227,974 B1 5/2001 Eilat
6,267,669 B1 7/2001 Luciano
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,938,727 B1 5/2011 Konkle
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,475,266 B2 7/2013 Arnone
8,480,470 B2 7/2013 Napolitano et al.
8,622,809 B1 1/2014 Arora et al.
2001/0004609 A1 6/2001 Walker et al.
2001/0019965 A1 9/2001 Ochi
2002/0022509 A1 2/2002 Nicastro et al.
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0177347 A1* 9/2003 Schneier ..... A63F 13/12 713/151
2003/0204565 A1 10/2003 Guo et al.
2003/0211879 A1 11/2003 Englman
2004/0092313 A1 5/2004 Saito et al.
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0020648 A1* 1/2006 Merati ..... G06F 7/582 708/250
2006/0035696 A1 2/2006 Walker
2006/0035708 A1* 2/2006 Nguyen ..... G07F 17/32 463/29
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0178188 A1* 8/2006 LeMay ..... G07F 17/32 463/16
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0207852 A1 9/2007 Nelson et al.
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly

(56) References Cited

U.S. PATENT DOCUMENTS

2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0036190 A1* 2/2009 Brosnan ..... G07F 17/3234 463/16
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0221365 A1* 9/2009 Levy ..... G06Q 50/34 463/29
2009/0239610 A1 9/2009 Olive
2009/0247272 A1 10/2009 Abe
2009/0270164 A1 10/2009 Seelig
2009/0275393 A1 11/2009 Kisenwether
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0201413 A1 8/2011 Oberberger
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0135793 A1 5/2012 Antonopoulos
2012/0202587 A1 8/2012 Allen
2012/0302311 A1 11/2012 Luciano
2012/0322545 A1* 12/2012 Arnone ..... G07F 17/3272 463/25
2013/0029760 A1 1/2013 Wickett
2013/0131848 A1 5/2013 Arnone et al.
2013/0190074 A1 7/2013 Arnone et al.
2013/0260869 A1 10/2013 Basallo et al.
2014/0087801 A1 3/2014 Nicely et al.
2014/0087808 A1 3/2014 Basallo et al.
2014/0087809 A1 3/2014 Leupp et al.
2014/0357350 A1 12/2014 Weingardt et al.

OTHER PUBLICATIONS

U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.

(56) References Cited

OTHER PUBLICATIONS

U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/799,481 Arnone, et al. filed Jul. 14, 2015.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
WIPO/IPEA International Preliminary Report on Patentability, PCT/US14/22151, dated Jul. 21, 2014.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/205,303 Arnone, et al., filed Mar. 11, 2014.
U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.

* cited by examiner

1600

Validation Record

1605

Header

Hash
Player ID
Player Session ID
Game Session ID
Sequence ID
Device ID
Time/Date Stamp
IP Address
Client Version

Image

1610

GAME HISTORY VALIDATION FOR NETWORKED GAMBLING HYBRID GAMING SYSTEM

CROSS-REFERENCE TO RELATED APPLICATIONS

The current application is a continuation of Patent Cooperation Treaty Application No. PCT/US14/22151, filed Mar. 7, 2014, which claims the benefit of U.S. Provisional Application No. 61/783,585, filed Mar. 14, 2013, the disclosure of which is incorporated herein by reference as if set forth herewith. The current application references Patent Cooperation Treaty Application Nos. PCT/US11/26768, filed Mar. 1, 2011, PCT/US11/63587, filed Dec. 6, 2011, and PCT/US12/50204 filed Aug. 9, 2012, each disclosure of which is hereby incorporated by reference in its entirety all of which are incorporated by reference as if set forth herewith.

FIELD OF THE INVENTION

Embodiments of the present invention are generally related to gaming and more specifically to systems and processes that provide game history validation in a gambling hybrid game.

BACKGROUND OF THE INVENTION

The gaming machine manufacturing industry provides a variety of gaming machines to enable wagering for interested parties whilst providing an entertainment experience. An exemplary gaming machine is a slot machine. As the demographic of eligible players has shifted with time to newer generations who have grown accustomed to highly sophisticated graphics and interactive video games, a need has arisen to increase the entertainment content present on a gaming machine to keep it relevant, at least to a growing portion of a casino's patronage. The subject design is a form of gaming machine, designed for use in a physical or virtual casino environment, which provides players an environment in which to play for cash, prizes and points, either against the casino or in head to head modes in a controlled and regulated manner while being allowed to use their skills and adeptness at a particular type of game. An example of such a game would be a challenging word spelling game, or an interactive action game such as is found on video game consoles popular today, such as a PlayStation®, an Xbox®, a Wii® or a PC based game.

SUMMARY OF THE INVENTION

The disclosed embodiments relate generally to an interactive entertainment game system where skill and chance may coalesce to provide a rich arcade-style gaming experience, visually exciting and challenging, where players may wager cash, credits prizes and points in order to win more of the foregoing. Many of the embodiments of the design provide an enticing gaming system to the players who expect a high level of entertainment content in their gaming experience compared to the relatively simple game systems in use today.

In accordance with embodiments of this invention, a gaming system for providing a gambling hybrid game that includes an entertainment game and a gambling game, includes a processing device constructed to execute the entertainment game, where the entertainment game generates entertainment game information, communicate, to a game world server, a signal including a trigger of a wager of game world credits triggered by a player's action during the player's skillful play of the entertainment game, receive, from the game world server, a signal including a result of a wager of game world credits triggered by the player's action during the player's skillful play of the entertainment game, display the result of the wager of game world credits triggered by the player's action during the player's skillful play of the entertainment game, obtain game history information in response to a trigger event, where the game history information includes current entertainment game information, store the game history information in a memory of the processing device, communicate, to the game world server, a signal including a portion of the game history information, receive, from the game world server, a signal including a request for the game history information where the game history information is verified by the game world server, and communicate, to the game world server, a signal including the game history information stored in the memory of the processing device, in response to the request.

In accordance with numerous embodiments, a gaming system for providing a gambling hybrid game that includes an entertainment game and a gambling game, further includes a real world server constructed to receive, from the game world server, a signal including a request for a resolution of a wager of game world credits triggered by the player's action during the player's skillful play of the entertainment game, determine the result of the wager of game world credits triggered by the player's action during the player's skillful play of the entertainment game and generate gambling game information, and communicate, to the game world server, the signal including the result of the wager of game world credits triggered by the player's action during the player's skillful play of the entertainment game.

In accordance with many embodiments, a gaming system for providing a gambling hybrid game that includes an entertainment game and a gambling game, further includes the game world server, connected to the processing device via a network and connected to the real world server via a communication link, constructed to continuously monitor the processing device for the signal including the trigger of the wager of game world credits triggered by the player's action during the player's skillful play of the entertainment game, receive, from the processing device, the signal including the trigger of the wager of game world credits triggered by the player's action during the player's skillful play of the entertainment game, determine whether to trigger the wager based on the signal including the trigger of the wager of game world credits triggered by the player's action during the player's skillful play of the entertainment game, communicate, to the real world server, the signal including the request for the resolution of the wager of game world credits triggered by the player's action during the player's skillful play of the entertainment game, receive, from the real world server, the signal including the result of the wager of game world credits triggered by the player's action during the player's skillful play of the entertainment game, communicate, to the processing device, the signal including the result of the wager of game world credits triggered by the player's action during the player's skillful play of the entertainment game, receive, from the processing device, the signal including the portion of the game history information, store the received portion of the game history information in a memory of the game world server, receive a request to validate the game history, communicate, to the processing device, the signal including the request for the game history information in response to receiving the request to validate the game history, receive, from the processing device, the signal including the game history information, retrieve the portion of the game history information in the memory of the game world server and verify the game history information received from the processing device based upon the retrieved at least a portion of the game history information.

In accordance with numerous embodiments, the game world server is further constructed to receive, from the processing device, a signal including the entertainment game information, detect a triggering event in the entertainment game information, and communicate, to the processing device, a signal including the request to obtain game history information.

In accordance with various embodiments, the game world server is further constructed to receive, from the real world server, a signal including the gambling game information, detect a triggering event in the gambling game information, and communicate, to the processing device, a signal including a request for game history information.

In accordance with many embodiments, the game history information is a game history record including a header and a captured screen image of a user interface provided by the processing device during the entertainment game.

In accordance with numerous embodiments, the processing device is further constructed to capture a screen image from a user interface, generate image information from the captured screen where the image information uniquely identifies the captured screen image, insert the image information into the header for the game history record, and generate the game history record including the header and the captured screen image.

In accordance with various embodiments, the portion of the game history information is the header of the game history record.

In accordance with many embodiments, the processing device is further constructed to apply a hash function to the captured screen image to generate a hash that is used as the image information.

In accordance with numerous embodiments, the game world server is further constructed to apply the hash function to the captured screen image in the game history record provided by the processing device in response to a request to generate a verification hash, compare the hash in the header stored to the verification hash, and verify the game history in response to a matching of the verification hash and the hash in the header stored.

a gambling hybrid game includes an entertainment system engine that executes an entertainment game, a real world engine that determines a result of the gambling event, and a game world engine that manages the entertainment game, determines when a gambling event occurs in the entertainment game, and requests that the gambling event be by the real world engine. The gambling hybrid game provides game history validation in the following manner in accordance with embodiments of the invention.

The entertainment system engine executes the entertainment game to generate entertainment game information. Game history information is obtained by the entertainment system engine in response to a trigger event. The game history information includes current entertainment game information. The obtained game history information is stored in a memory by the entertainment system engine and at least a portion of the game history information is provided by the entertainment system engine to the game world engine. The game world engines stores the received at least a portion of the game history information in a memory.

The game world engine receives a request to validate a game history. In response to receiving the request to validate the game history, the game world engine requests the game history information from the entertainment system engine. The entertainment system engine provides the game history information stored in the memory to the game world engine in response to the request. The game world engine also retrieves the at least a portion of the game history information stored in the memory and verifies the game history information received from the entertainment system engine based upon the retrieved at least a portion of the game history information.

In accordance with many embodiments of the invention, the game world engine receives the entertainment game information from the entertainment system engine and detects a triggering event in the entertainment game information using the game world engine. Based on the detection of the triggering event, the game world engine sends a request to obtain game history information to the entertainment system engine. The game history information is obtained by the entertainment system engine in response to request to obtain game history information.

In accordance with a number of embodiments of the invention, the game world engine determines a gambling event is to occur based upon the game information received from the entertainment system engine. The game world engine sends a request to resolve the gambling event to the real world engine. The reals world engine resolves the gambling event to generate gambling game information and provides the gambling game information to the game world engine. The game world engine detects the triggering event in the gambling game information and sends a request to obtain game history information to the entertainment system engine.

In accordance with some embodiments of the invention, the game history information is a game history record including a header and a captured screen image of a user interface provided by the entertainment system engine during the entertainment game and the game history information is obtained in the following manner. The entertainment system engine captures a screen image from a user interface using the entertainment system engine and generates image information from the captured screen. The image information uniquely identifies the captured screen image using the entertainment system engine and is inserted into a header for the game history record by the entertainment system engine. The entertainment system engine generates a game history record including the header and the captured screen image. In accordance with a number of embodiments, the at least a portion of the game history information is the header of the game history record.

In accordance with many of the embodiments, the image information is a hash that is generated by applying a hash function to the captured screen image. In accordance with a number of embodiments, the game information is verified by applying the hash function to the captured screen image in the game history record provided by the entertainment system engine to the game world engine in response to the request to generate a verification hash. The game world engine compares the hash in the header stored by game world engine to the verification hash and verifies the game history in response to the verification hash and the hash in the header stored by the game world engine matching.

DETAILED DISCLOSURE OF THE INVENTION

Turning now to the drawings, systems and methods for providing a gambling hybrid game with game history validation in accordance with embodiments of this invention are disclosed. In accordance with embodiments of this invention, a gambling hybrid game includes an entertainment system engine that executes an entertainment game, a real world engine that determines a result of a gambling event, and a game world engine that manages the entertainment game, determines when a gambling event occurs in the entertainment game, and requests that the gambling event be resolved by the real world engine. In order to provide game history validation, game history information for the gambling hybrid game is stored in a game history validation database maintained by an entertainment system engine when a triggering event occurs. For purposes of this discussion, a triggering event is an occurrence of an event in either an entertainment game or a gambling game provided by a gambling hybrid that meets a predetermined metric. Some examples of triggering events in accordance with embodiments of the invention include, but are not limited to, the expiration of a time period during entertainment gameplay, the reaching of the end of a level during gameplay of the entertainment game, a payout of a wager on a gambling event, a loss of a wager during a gambling event.

The entertainment engine also provides at least a portion of the stored game history information to the game world engine. In accordance with some embodiments of the invention, the entertainment world engine and the game world engine are provided by separate devices that communicate via a network connection. The game world engine stores the portion of the game history information received from the entertainment system engine in a game history validation database maintained by the game world engine.

When a game history validation request is later received by the game world engine. The game world engine sends a request to the entertainment system engine for the game history information stored in game history validation database maintained by the entertainment system engine provides the game history information stored in the game history validation database to the game world engine. The game world engine then uses the portion of the game history information stored in the game history validation database to validate the game history information received from the entertainment system engine.

Systems and methods for providing a gambling hybrid game with game history validation in accordance with embodiments of this invention are described below with reference to the provided drawings.

Gambling Hybrid Games

Figure 1:
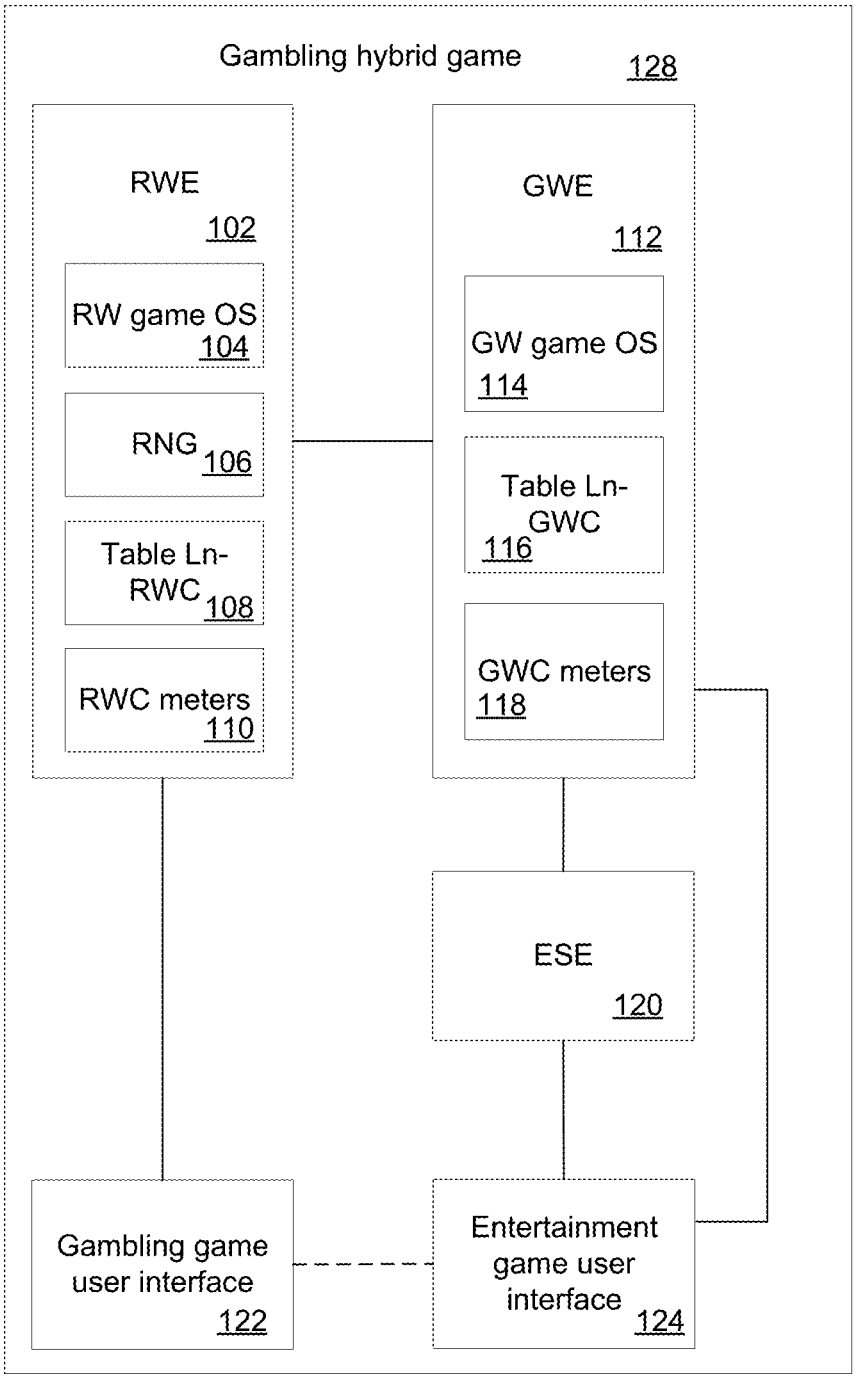
FIG. 1 illustrates a conceptual diagram of components of a gambling hybrid game in accordance with an embodiment of the invention.

In accordance with many embodiments of this invention, a gambling hybrid game integrates high-levels of entertainment content with a game of skill (an entertainment game) and a gambling experience with a game of chance (a gambling game). A gambling hybrid game provides for random outcomes independent of player skill while providing that the user's gaming experience (as measured by obstacles/challenges encountered, time of play and other factors) is shaped by the player's skill. The outcome of a gambling proposition that is determined by a Random Number Generator (RNG) or other such device that provides a random outcome in response to a request. In accordance with some embodiments, the wager game may be initiated in response to a game object related player action. A gambling hybrid game in accordance with an embodiment of the invention is illustrated in FIG. 1. The gambling hybrid game 128 includes a Real World Engine (RWE) 102, a Game World Engine (GWE) 112, an Entertainment System Engine (ESE) 120, a gambling game user interface 122 and an entertainment game user interface 124. The two user interfaces can be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In accordance with several embodiments, the RWE 102 is the operating system for the gambling game of the gambling hybrid game 128 and controls and operates the gambling game. The operation of a gambling game is enabled by Real World Currency (RC), such as money or other real world funds. A gambling game can increase or decrease an amount of RC based on random gambling outcomes, where the gambling proposition of a gambling game is typically regulated by gaming control bodies. In many embodiments, the RWE 102 includes a Real World (RW) operating system (OS) 104, RNG 106, level n real-world credit pay tables (Table Ln-RC) 108, RC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithms and/or processes, which are used to generate random outcomes. A level n real-world credit pay table (Table Ln-RC) 108 is a table that can be used in conjunction with a Random Number Generator (RNG) 106 to dictate the RC earned as a function of sponsored gameplay and is analogous to the pay tables used in a conventional slot machine. Table Ln-RC payouts are independent of player skill. There can be one table or multiple tables included in Ln-RC pay tables 108 contained in a gambling game, the selection of which can be determined by factors including (but not limited to) game progress that a player has earned, and/or bonus rounds for which a player can be eligible. RCs are credits analogous to slot machine game credits, which are entered into a gambling game by the user, either in the form of money such as hard currency or electronic funds. RCs can be decremented or augmented based on the outcome of a random number generator according to the table Ln-RC real world credits pay table 108, independent of player skill. In certain embodiments, an amount of RC can be used as criteria in order to enter higher ESE game levels. RC can be carried forward to higher game levels or paid out if a cash out is opted for by a player. The amount of RC used to enter a specific level of the game, level n, need not be the same for each level.

In accordance with some embodiments of this invention, the GWE 112 manages the overall gambling hybrid game operation, with the RWE 102 and the ESE 120 effectively being support units to the GWE 112. In accordance with some of these embodiments, the GWE 112 contains mechanical, electronic, and software systems for an entertainment game. The GWE 112 includes an Operating System (OS) 114 that provides control of the entertainment game. The GWE additionally contains a level n game world credit pay table (table Ln-GWC) 116 from where to take input from this table to affect the play of the entertainment game. The GWE 112 can further couple to the RWE 102 to determine the amount of RC available on the game and other metrics of wagering on the gambling game (and potentially affect the amount of RC in play on the RWE). The GWE additionally contains various audit logs and activity meters (such as the GWC meter) 118. The GWE 112 can also couple to a centralized server for exchanging various data related to the player and his or her activities in the game. The GWE 112 furthermore couples to the ESE 120.

In accordance with some embodiments, a level n game world credit pay table (Table Ln-GWC) 116 dictates the Game World Credit (GWC) earned as a function of player skill in the nth level of the game. The payouts governed by this table are dependent upon player skill and sponsored gameplay at large and can or cannot be coupled to a RNG. In accordance with some embodiments, GWCs are player points earned or depleted as a function of player skill, specifically as a function of player performance in the context of the entertainment game. GWC is analogous to the score in a typical video game. Each entertainment game has one or more scoring criterion, embedded within the table Ln-GWC 116 that reflects player performance against the goal(s) of the game. GWCs can be carried forward from one level of sponsored gameplay to another, and ultimately paid out in various manners such as directly in cash, or indirectly such as by earning entrance into a sweepstakes drawing, or earning participation in, or victory in, a tournament with prizes. GWCs can be stored on a player tracking card or in a network-based player tracking system, where the GWCs are attributed to a specific player.

In accordance with certain embodiments, the operation of the GWE does not affect the RWE's gambling operation except for player choice parameters that are allowable in slot machines, including but not limited to, wager terms such as, but not limited to, a wager amount, how fast the player wants to play (by pressing a button or pulling the handle of a slot machine), and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RC available in the gambling game. The communication link can also convey a status operation of the RWE (such as on-line or tilt). The communication link can further communicate the various gambling control factors which the RWE 102 uses as input, such as the number of RC consumed per game or the player's election to enter a jackpot round. In FIG. 1, the GWE 112 is also shown as connecting to the player's user interface directly, as this can be utilized to communicate certain entertainment game club points, player status, control the selection of choices and messages which a player can find useful in order to adjust the entertainment game experience or understand their gambling status in the RWE 102.

In accordance with various embodiments of this invention, the ESE 120 manages and controls the visual, audio, and player control for the entertainment game. In accordance with certain embodiments, the ESE 120 accepts input from a player through a set of hand controls, and/or head, gesture, and/or eye tracking systems and outputs video, audio and/or other sensory output to a user interface. In accordance with many embodiments, the ESE 120 can exchange data with and accept control information from the GWE 112. In accordance with some of these embodiments, an ESE 120 can be implemented using a Personal Computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In accordance with some of these embodiments, ESE 120 can be an electromechanical game system of a gambling hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 can send certain entertainment game control parameters and elements to the ESE 120 to affect its play, such as (but not limited to) what level of character to be using, changing the difficulty level of the game, changing the type of gun or car in use, and/or requesting portions to become available or to be found by the character. These game control parameters and elements can be based on a gambling outcome of a gambling game that was triggered by an element in the entertainment game being acted upon by the player. The ESE 120 can accept this input from the GWE 112, make adjustments, and continue entertainment game gameplay all the while running seamlessly from the player's perspective. The ESE's operation is mostly skill based, except for where the ESE's processes can inject complexities into the game by chance in its normal operation to create unpredictability in the entertainment game. Utilizing this interface, the ESE 120 can also communicate player choices made in the game to the GWE 112, such as but not limited to selection of a different gun, and/or the player picking up a special portion in the GW environment. The GWE's function in this architecture, being interfaced with the ESE 120, is to allow the transparent coupling of entertainment software to a fair and transparent random chance gambling game, providing a seamless perspective to the player that they are playing a typical popular entertainment game (which is skill based). In accordance with certain embodiments, the ESE 120 can be used to enable a wide range of entertainment games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In accordance with some embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RC in play, and amount of RC available. The RWE 102 can accept modifications in the amount of RC wagered on each individual gambling try, or the number of gambling games per minute the RWE 102 can execute, entrance into a bonus round, and other factors, all the while these factors can take a different form than that of a typical slot machine. An example of a varying wager amount that the player can choose can include, but is not limited to, gameplay with a more powerful character, a more powerful gun, or a better car. These choices can increase or decrease the amount wagered per individual gambling game, in the same manner that a standard slot machine player can decide to wager more or less credits for each pull of the handle. In accordance with some of these embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In accordance with a particular embodiment, the RWE 102 operation can be a game of chance as a gambling game running every 10 seconds where the amount wagered is communicated from the GWE 112 as a function of choices the player makes in the operation profile in the entertainment game.

In many embodiments, a gambling hybrid game integrates a video game style gambling machine, where the gambling game (including an RWE 102 and RC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time, a rich environment of rewards to stimulate gamers can be established with the entertainment game. In accordance with some of these embodiments, the gambling hybrid game can leverage very popular titles with gamers and provides a sea change environment for casinos to attract players with games that are more akin to the type of entertainment that a younger generation desires. In accordance with various embodiments, players can use their skill towards building and banking Game World Credit (GWC) that in turn can be used to win tournaments and various prizes as a function of their gamer prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In accordance with some embodiments, gambling hybrid games also allow players to gain entry into subsequent competitions through the accumulation of Game World Credits (GWC) as a function of the user's demonstrated skill at the game. These competitions can pit individual players or groups of players against one another and/or against the casino to win prizes based upon a combination of chance and skill. These competitions can be either asynchronous events, whereby players participate at a time and/or place of their choosing, or they can be synchronized events, whereby players participate at a specific time and/or venue.

In accordance with some embodiments, one or more players engage in playing an entertainment game, resident in the ESE, the outcomes of which are dependent at least in part on skill. The gambling hybrid game can include an entertainment game that includes head to head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to Solitaire and Babette).

In accordance with some embodiments, the use of the RWE, GWE and ESE allows for the separation of control of a gambling hybrid game between different devices. For example, the ESE may be hosted by a device that is separate from any devices that host the RWE and/or GWE. Through separation of control of the functions of the ESE, RWE and GWE, the RWE may be isolated from the player's device, thus preventing player interference with the RWE and the gambling game. In addition, as the ESE is responsible for providing the entertainment game, gambling hybrid games may provide for complex entertainment games for the player as the ESE need not include the tightly regulated components of the RWE, thus providing for more freedom in ESE design. Also, separation of control allows a GWE to provide complex wager initiation rules that would not be possible if the either the ESE or the RWE were to be in control of the wager initiation.

In accordance with various embodiments, a gambling hybrid game allows for interleaving of continuous wagering within an entertainment game. For example, instead of wagering once, and then playing an entertainment game to completion, or playing an entertainment game to completion and then placing a wager, a gambling hybrid game allows a gaming system or device to be provided to a player where the gaming system or device provides a complex and interesting entertainment game with wagering incorporated throughout the entertainment game.

In various embodiments, a gambling hybrid game provides for feedback into the entertainment game of additional entertainment game resources that are made available in the ESE for the use of the player as the result of wagering outcomes. The additional entertainment game resources may enable portions of the entertainment game that were not available to the player without the resources.

In many embodiments, a gambling hybrid game provides the ability to use the gambling hybrid game in more than one jurisdiction, as the ESE is a component separate from the GWE and RWE. For example, the ESE may be operated as either a pure entertainment game, or as a gambling game depending on the type of characteristics of the RWE that the ESE is coupled to.

In some embodiments, a gambling hybrid game provides for display of an entertainment game on a player's device that the player is using to interact with the entertainment game, as well as providing a separate display of a state of a gambling game on a separate gambling game display. The separate gambling game display may be on the player's device within the same physical display device, on a separate device having a separate physical screen, or on a separate physical display device on the player's device.

Figure 2:
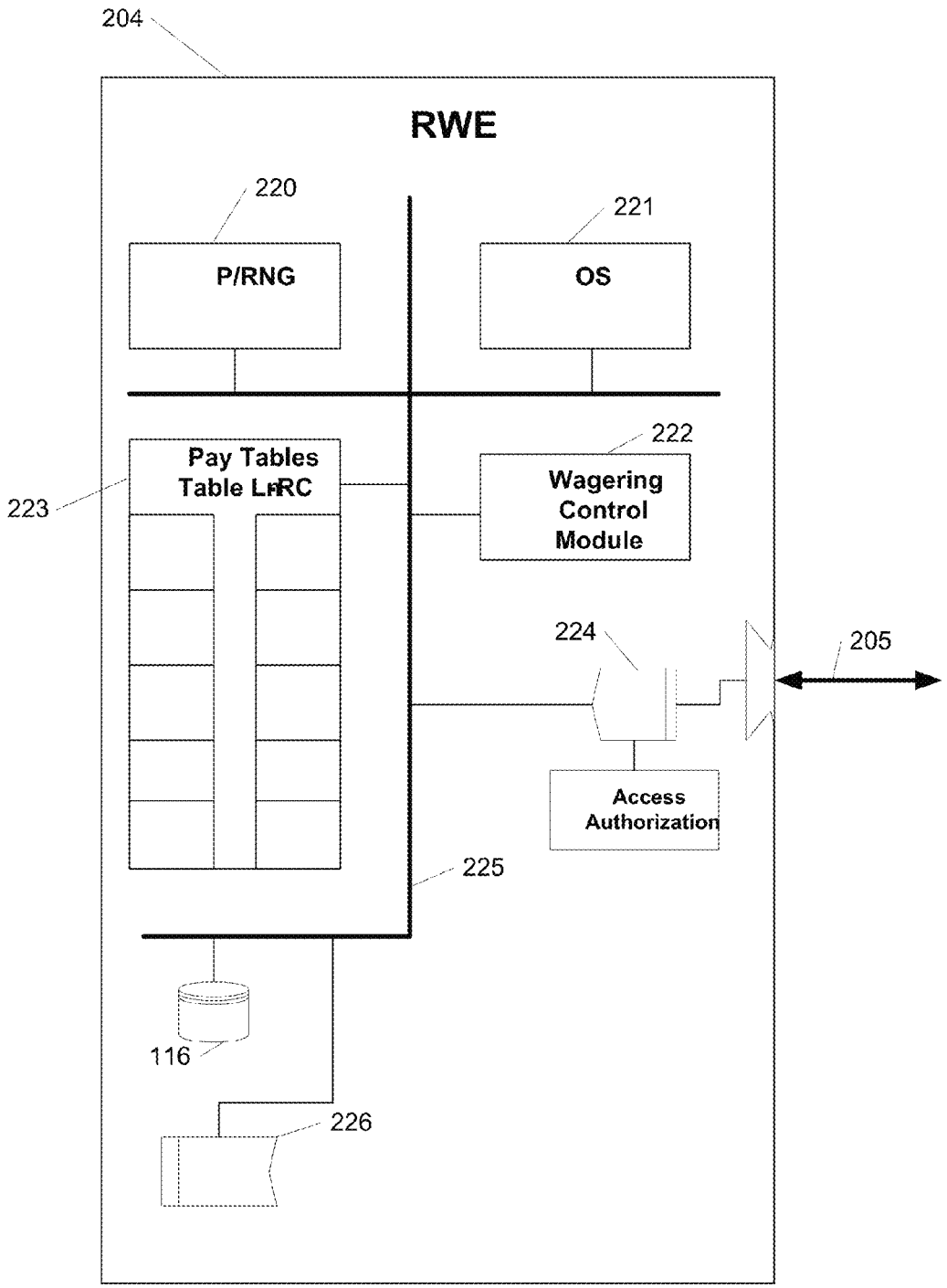
FIG. 2 illustrates a conceptual diagram of aspects of a Real World Engine (RWE) of a gambling hybrid game in accordance with some embodiments of the invention.

The components provided by the RWE for a gambling hybrid game in accordance with embodiments of the invention are shown in FIG. 2. In accordance with embodiments of the invention, the RWE includes an internal bus 225 that connects an operating system OS 221, a Pseudo Random or Random Number Generator (P/RNG) 220, one or more pay tables (Table Ln-RC) 223, a wagering control module 222, an authorization access module 224, and a RC credit meter 226 that are included in the RWE 204. The RW OS 221 controls the functions of the RWE 204. The P/RNG 220 includes one or more RNGs that are used to produce random numbers for use in resolving gambling events and other process requiring a random number to determine an outcome. The one or more pay tables (Table Ln-RC) 223 control the functions of the RWE and contain a plurality of factors indexed by the random number to be multiplied with the RC wagered to determine the payout on a successful wager. A wagering control module 222 performs the processes to resolve a wager on a proposition of a gambling event. The resolution process includes, but is not limited to, pulling random numbers, looking up factors in Pay Tables, multiplying the factors by the amount of RC wagered, and administering a RC credit meter 226. A repository (a credit meter) 226 maintains a record of the amount of RC which a player has deposited in the game and has been accumulated by the player.

An external connection allows the RWE 204 to interface to another system or device, which is shown in FIG. 2 as the Internet 205 but may be any other network and/or device. The authorization access module 224 of RWE 204 is connected to the external connection and provides a method to permit access and command exchange between an external system and the RWE 204. The RWE 204 also contains storage for statuses, wagers, wager outcomes, meters and other historical events in a storage device 116.

Figure 3:
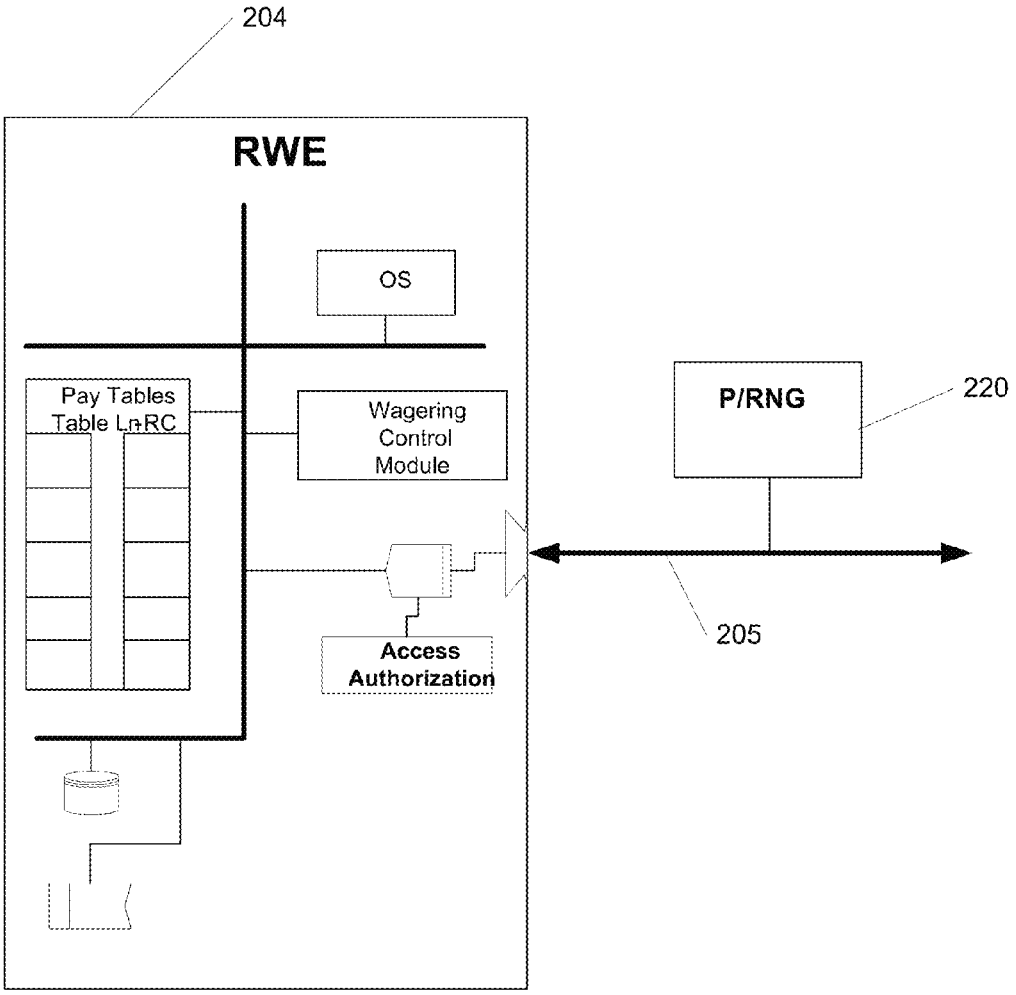
FIG. 3 illustrates a conceptual diagram of aspects of a Real World Engine (RWE) of a gambling hybrid game in accordance with some other embodiments of the invention.

In some embodiments, the RWE 204 communicates with external systems to provide various functions of a gambling hybrid game in accordance with embodiments of the invention. The components of an RWE 204 that communicate with an external system to provide a component of the RWE 204 in accordance with embodiments of the invention are shown in FIG. 3. The RWE 204 shown in FIG. 3 is similar to the RWE shown in FIG. 2. However, the P/RNG 220 is an external system connected to the RWE 204 by the Internet 205 in accordance with embodiments of the invention. The P/RNG 220 could be a central deterministic system, such as a regulated and controlled random numbered ball selection device, or some other system which provides random or pseudo random numbers to one or a plurality of connected RWEs 204. One skilled in the art will recognize that only P/RNG 220 is an external system in the embodiment illustrated in FIG. 3. However, any of the components could be external systems without departing from the invention and P/RNG 220 is shown as an example only.

In FIGS. 2 and 3, the RWE 204 interfaces with other systems/devices or to an external P/RNG 220 using the Internet 205. However, one skilled in the art will note that nothing would preclude using a different interface than the Internet 205 in other embodiments of the invention. Other examples of interfaces include, but are not limited to, a LAN, a USB interface, or some other method by which two electronic and software constructs could communicate with each other.

Figure 4:
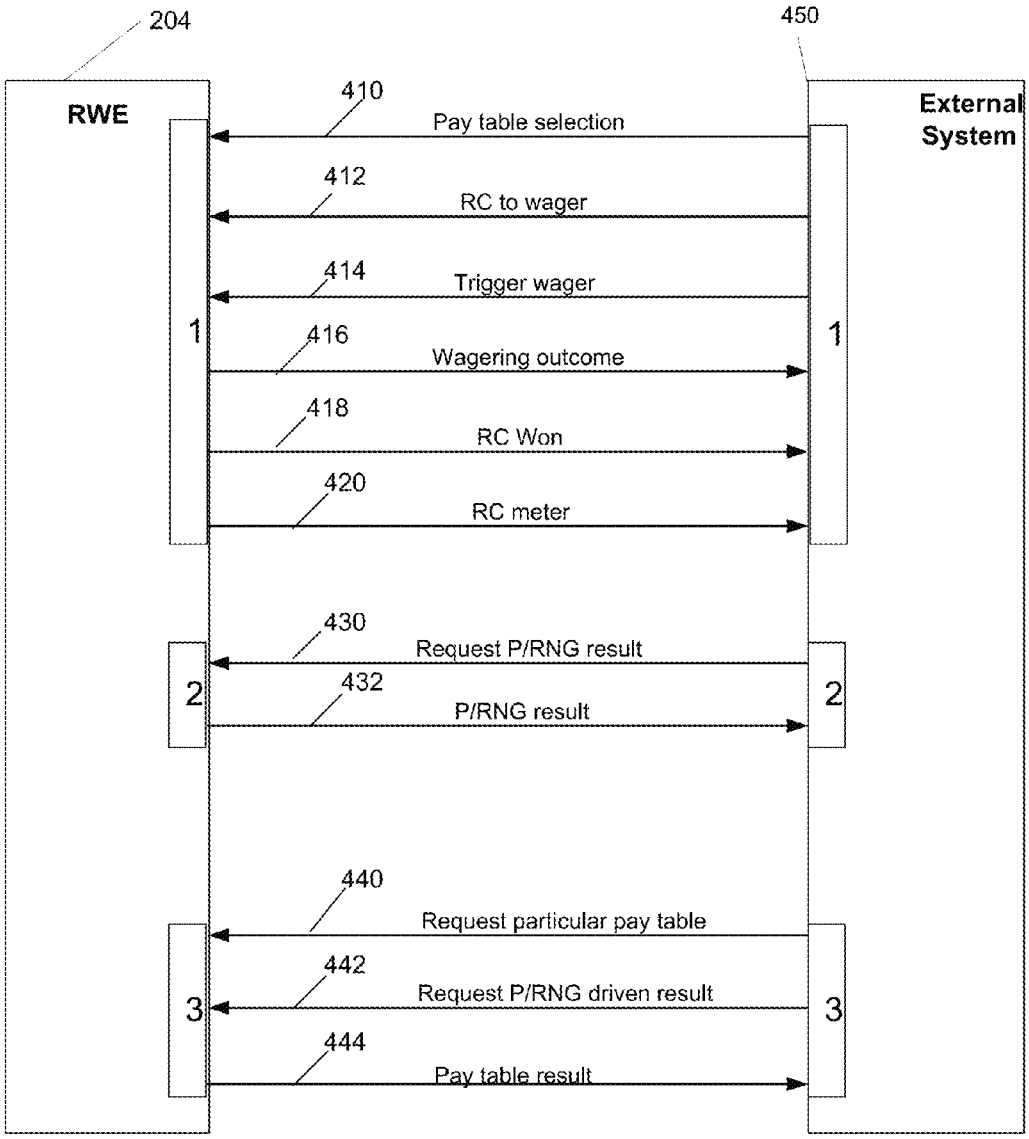
FIG. 4 illustrates a signaling diagram of communications between a Real World Engine (RWE) and an external system to provide various functions in accordance with embodiments of the invention.

The RWE and an external system typically communicate to provide the resolution of gambling events to resolve wagers on the events. The signals between the RWE and an external system to provide some process related to resolving gambling events in accordance with embodiments of the invention are shown in FIG. 4. In accordance with many embodiments of the invention, the primary function of the RWE 204 is to manage wagering events and to provide random (or pseudo random) numbers from an RNG. At the top of the figure, a 6 component communication exchange grouped by the "1" box is shown for a wager on a proposition in a gambling event during a gambling hybrid game in accordance with embodiments of the invention. An external system 450 that is requesting wagering support from the RWE 204 instructs the RWE 204 as to the pay table (Table Ln-RC) to use (410), followed by the amount of RC to wager on the proposition of the gambling event (412). Next, the external system 450 signals the RWE to trigger a wager or perform the gambling event (414). The RWE 204 resolves the gambling event. The RWE 204 then informs external system 450 as to the outcome of the wager (416), the amount of RC won (418), and the amount of RC in the player's account (in the credit repository) (420).

A second communication exchange between the RWE 204 and an external system 450 in accordance with embodiments of the invention that is shown in FIG. 4 is grouped by the "2" box in FIG. 4 and relates to the external system 450 needing an P/RNG result support from the RWE 204. In this exchange, the external system 450 requests an P/RNG result from the RWE 204 (430). The RWE 204 returns a P/RNG result to the external system 450 in response to the request (432). The result may be generated as a function of the internal P/RNG in the RWE 204, or from a P/RNG external to the RWE 204 to which the RWE 204 is connected.

A third communication exchange between the RWE 204 and the external system 450 in accordance with embodiments of the invention that is shown in FIG. 4 is grouped by the "3" box in the figure and relates to the external system 450 wanting support on coupling an P/RNG result to a particular Pay Table contained in the RWE 204. In this exchange, the external system 450 instructs the RWE as to the pay table (Table Ln-RC) to use (440). The external system (450) then requests a result whereby the P/RNG result is coupled to the requested Pay Table (442). The result is returned to the external system 450 by RWE 204 (444). Such an aspect is different from the first exchange shown by the box "1" sequence in that no actual RC wager is conducted. However, such a process, t, might be useful in coupling certain non-RC wagering entertainment game behaviors and propositions to the same final resultant wagering return which is understood for the gambling hybrid game to conduct wagering.

In regards to FIG. 4, one skilled in the art will note that the thrust of the FIG. 4 is to convey overall functional exchanges between an RWE 204 and an external system 450. As such, various protocol layers necessary for error free and secure communication, and other status, setup, and configuration commands which one might expect in any protocol between two connected systems have been omitted for clarity. Furthermore, some or all of the various commands and responses illustrated could be combined into one or more communication packets without departing from the invention.

Figure 5:
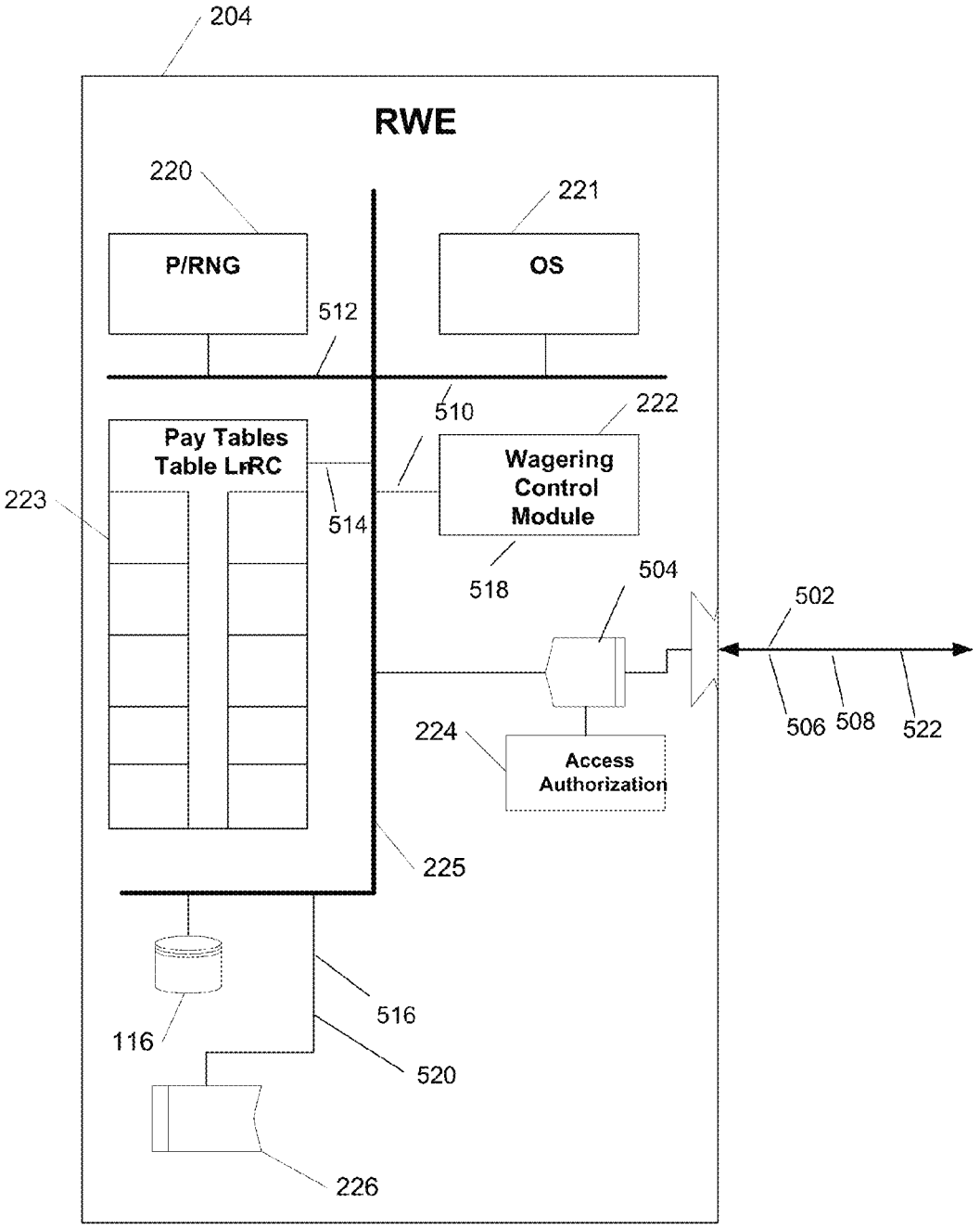
FIG. 5 illustrates a diagram of a process flow and signaling in a Real World Engine (RWE) to provide various functions in accordance with embodiments of the invention.

The process flow for functional communication exchanges, such as communication exchanges described above with reference to FIG. 4, between a RWE and an external system in accordance with embodiments of the invention are shown in FIG. 5. The process begins by a RWE 204 receiving signals from an external system requesting a connection to RWE 204 (502). The Access Authorization Module determines that the external system is authorized to connect to RWE 204 (504) and transmits an authorization response to the external system. The external systems provide a request for a gambling event to be performed to the RWE 294 (506). The request may include an indication of a wager amount on a proposition in the gambling event, and a proper pay table to use to resolve the wager. The external system then sends a signal to trigger the gambling event (508).

The OS 221 instructs the Wager Control Module 222 as to the RC wager and the Pay Table to select as well as to resolve the wager execution (510). In response to the request to execute the gambling event, the wager control module 222 requests an P/RNG result from the P/RNG 220 (512); retrieves a proper pay table or tables from the pay tables 223 (514); adjusts the RC of the player in the RC repository 226 as instructed (516); applies the P/RNG result to the particular pay table or tables (518); and multiplies the resultant factor from the Pay Table by the amount of RC to determine the result of the wager (518). Wager Control Module 222 then adds the amount of RC won by the wager to the RC repository 226 (520); and provides the outcome of the wager, and the amount of RC in the RWE and the RC won (522). One skilled in the art will recognize that there may be many embodiments of an RWE 204 which could be possible, including forms where many modules and components of the RWE are located in various servers and locations, so the foregoing is not meant to be exhaustive or all inclusive, but rather provide information about an RWE 204 in accordance with some embodiments of the invention.

Figure 6:
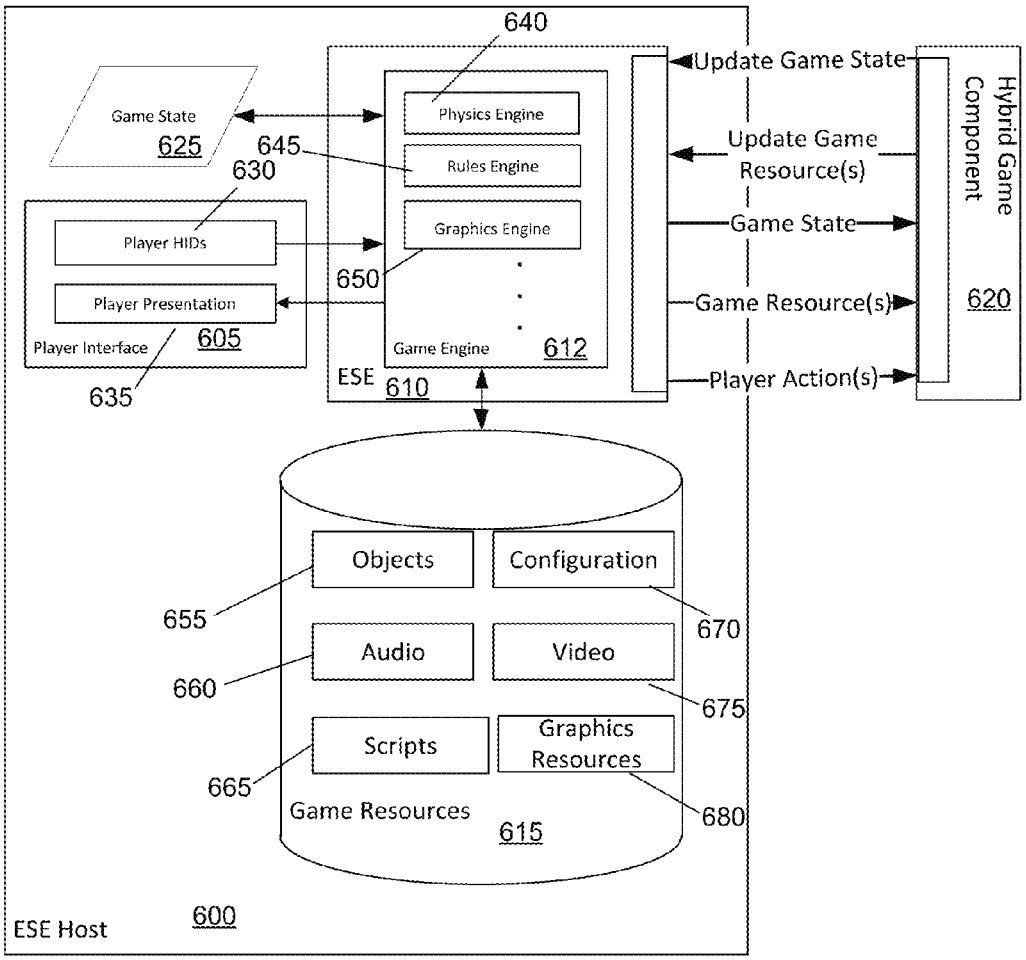
FIG. 6 illustrates a conceptual diagram of aspects of an Entertainment System Engine (ESE) in accordance with embodiments of the invention.

A block diagram of components of an ESE being provided by an ESE host 600 for a gambling hybrid game in accordance with embodiments of the invention is shown in FIG. 6. An ESE 610 may be part of the entertainment game itself, may be a software module that is executed by the entertainment game, or may provide an execution environment for the entertainment game for a particular host. The ESE 610 and associated entertainment game are hosted by an ESE host 600. The ESE host 600 is a computing device that is capable of hosting the ESE 610 and the entertainment game. Exemplary hosts include video game consoles, smart phones, personal computers, tablet computers, or the like. The entertainment game includes a game engine 612 that generates a player interface 605 for interaction with by a player. The player interface includes a player presentation 635 that is presented to a player through the player interface. The player presentation 635 may be audio, visual or tactile, or any combination of such. The player interface 635 further includes one or more Human Input Devices (HIDs) 630 that the player uses to interact with the entertainment game. Various components or sub-engines of the game engine read data from a game state in order to implement the features of the game. Components of the game engine include a physics engine 640 used to simulate physical interactions between virtual objects in the game state, a rules engine 645 for implementing the rules of the game, an P/RNG that may be used for influencing or determining certain variables and/or outcomes to provide a randomizing influence on gameplay, a graphics engine 650 used to generate a visual representation of the game state to the player, an audio engine to generate audio outputs for the player interface, and any other engine needed to provide the entertainment game. The game engine 612 reads and writes game resources 615 stored on a data store of the ESE host. The game resources 615 include game objects 655 having graphics and/or control logic used to implement game world objects of the game engine. The game resources 615 also include video files 675 that are used to generate cut-scenes for the entertainment game. The game resources 615 may also include audio files 660 used to generate music, sound effects, etc. within the entertainment game. The game resources 615 may also include configuration files 670 used to configure the features of the entertainment game. The game resources 615 may also include scripts 665 or other types of control code used to implement various gameplay features of the entertainment game. The game resources 615 may also include graphics resources 680 including, but not limited to, textures, and objects that are used by the game engine to render objects displayed in the entertainment game.

In operation, components of the game engine 612 read portions of the game state 625 and generate the player presentation for the player which is presented to the player using the player interface 605. The player perceives the presentation 635 and provides player inputs using the HIDs 630. The corresponding player inputs are received as player actions or inputs by various components of the game engine 612. The game engine translates the player actions into interactions with the virtual objects of the game world stored in the game state 625. Components of the game engine 612 use the player interactions with the virtual objects of the game and the game state 625 to update the game state 625 and update the presentation 635 presented to the user. The process can loop in a game loop continuously while the player plays the game.

In some embodiments, the ESE 610 is a host running a browser that communicates with a server serving documents in a markup language, such as Hypertext Markup Language 5 (HTML 5) or the like, and the functions of the game engine are performed by the browser on the basis of the markup language found in the documents. In some embodiments, the ESE 610 is a host hosting a specialized software platform, such as Adobe Flash or the like, used to implement games or other types of multimedia presentations, and the functions of the game engine are performed by the specialized platform.

The ESE 610 provides one or more interfaces between an entertainment game and other components 620 of a gambling hybrid game, such as a GWE. The ESE 610 and the other gambling hybrid game component 620 communicate with each other using the interfaces, such as by passing various types of data and sending and receiving messages, status information, commands and the like. Examples of communications include, but are not limited to, requesting by the gambling hybrid game component 620 that the ESE 610 update the game state using information provided by the other component; requesting, by the gambling hybrid game component 620, that the ESE 610 update one or more game resources using information provided by the gambling hybrid game component 620; the ESE 610 providing all or a portion of the game state; the ESE 610 providing one or more of the game resources to the gambling hybrid game component 620; and the ESE 610 communicating player actions to the other gambling hybrid game component 620. The player actions may be low level player interactions with the player interface, such as manipulation of an HID, or may be high level interactions with objects as determined by the entertainment game. The player actions may also include resultant actions such as modifications to the game state or game resources resulting from the player's actions taken in the game. Other examples of player actions include actions taken by entities, such as Non-Player Characters (NPC) of the entertainment game, that act on behalf of, or under the control of, the player.

Elements are a limited resource consumed within an entertainment game to advance entertainment game gameplay. In playing the entertainment game using the elements, a player can (optionally) consume and accrue game world credits (GWC) within the entertainment game. These credits can be in the form of (but are not limited to) game world credits, experience points, or points generally. Wagers can be made in the gambling game as triggered by the player's use of one or more elements of the entertainment game. The wagers are made using real world credits (RC). The real world credits can be credits in an actual currency, or can be credits in a virtual currency which may have a real world value. Gambling outcomes from the gambling game can cause consumption, loss or accrual of RC. In addition, gambling outcomes in the gambling game can influence elements in the entertainment game such as (but not limited to) by restoring a consumed element, causing the loss of an element, restoration or placement of a fixed element. In certain embodiments, gambling games can facilitate the wager of GWC for a randomly generated payout of GWC or a wager of elements for a randomly generated payout of elements. In particular embodiments, an amount of GWC and/or elements used as part of a wager can have a RC value if cashed out of a gameplay session.

Example elements include enabling elements (EE) which are elements that enable a player's play of the entertainment game and whose consumption by the player while playing the entertainment game can trigger a wager in a gambling game. Another non limiting example of an element is a reserve enabling element (REE), which is an element that converts into one or more enabling elements upon occurrence of a release event in skill wagering interleaved game gameplay. Other types of elements include actionable elements (AE) which are elements that are acted upon to trigger a wager in the gambling game and may or may not be restorable during normal play of the entertainment game. Another type of element is a common enabling element (CEE) which as an element that may be shared by two or more players and the use of which by any of the players causes a wager to be triggered.

In progressing through entertainment game gameplay, elements can be utilized by a player during interactions with a controlled entity (CE) which is a character, entity, inanimate object, device or other object under control of a player.

Also, entertainment game gameplay progress and wager triggers can be dependent upon a game world variable such as, but not limited to: a required game object (RGO) which is a specific game object in an entertainment game acted upon for an AE to be completed (such as but not limited to a specific key needed to open a door); a required environmental condition (REC) which is a game state present within an entertainment game for an AE to be completed (such as but not limited to daylight whose presence enables a character to walk through woods); or a controlled entity characteristic (CEO) which is a status of the CE within an entertainment game for an AE to be completed (such as but not limited to a CE to have full health points before entering battle). Although various gameplay resources, such as but not limited to GWC, RC and elements as discussed above, any gameplay resource can be utilized to advance gameplay as well as form the basis for a trigger of a wager as appropriate to the specification of a specific application in accordance with various embodiments of the invention. Various hybrid games are discussed in PCT Application Nos. PCT/US11/26768, filed Mar. 1, 2011, PCT/US11/63587, filed Dec. 6, 2011, and PCT/US12/50204 filed Aug. 9, 2012, each disclosure of which is hereby incorporated by reference in its entirety.

Figure 7:
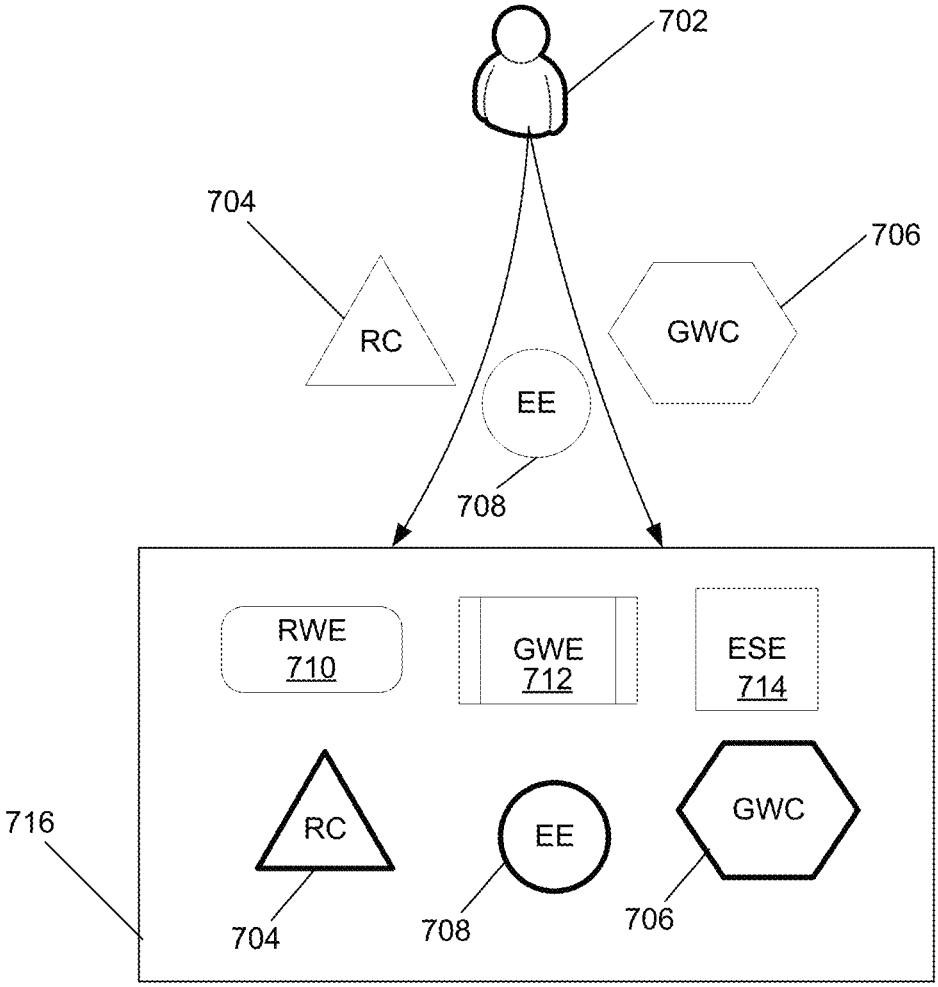
FIG. 7 illustrates a conceptual diagram of interactions between a user and a gambling hybrid game in accordance with embodiments of the invention.

In accordance with some embodiments, a player can interact with a gambling hybrid game by using RC in interactions with a gambling game along with GWC and elements in interactions with an entertainment game. The gambling game can be executed by a RWE while an entertainment game can be executed with an ESE and managed with a GWE. A conceptual diagram that illustrates how resources such as GWC, RC and elements, such as but not limited to enabling elements (EE), are utilized in a gambling hybrid game in accordance with an embodiment of the invention is illustrated in FIG. 7. The conceptual diagram illustrates that RC 704, EE 708 and GWC 706 can be utilized by a player 702 in interactions with the RWE 710, GWE 712 and ESE 714 of a gambling hybrid game 716. The contribution of elements, such as EE 708, can be linked to a player's access to credits, such as RC 704 or GWC 706. Electronic receipt of these credits can come via a smart card, voucher or other portable media, or as received over a network from a server. In accordance with certain embodiments, these credits can be drawn on demand from a player profile located in a database locally on a gambling hybrid game or in a remote server.

Figure 8:
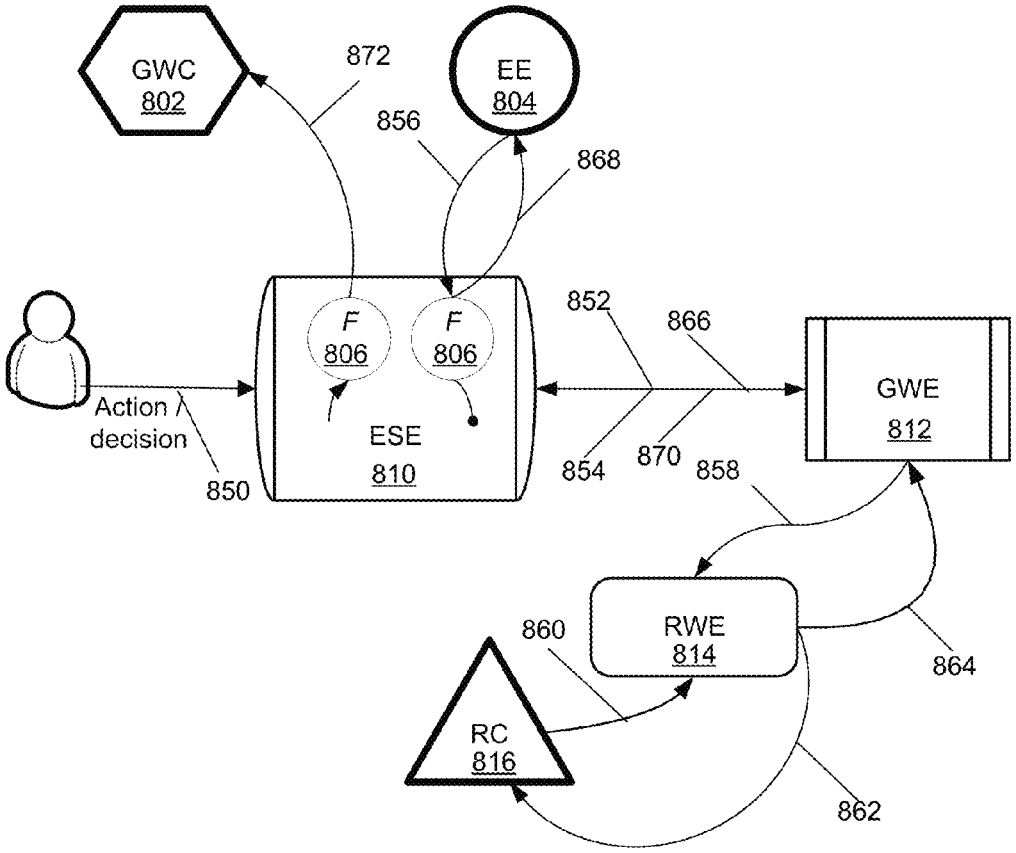
FIG. 8 illustrates a conceptual diagram of the interplay between aspects of a gambling hybrid game in accordance with some embodiments of the invention using Real World Currency (RC).

A conceptual diagram that illustrates the interplay between aspects of a gambling hybrid game in accordance with an embodiment of the invention using real world credit (RC) is illustrated in FIG. 8. Similar to FIG. 7, a player's actions and/or decisions can affect functions 806 that consume and/or accumulate GWC 802 and/or EE 804 in an entertainment game executed by an ESE 810. A GWE 812 can monitor the activities taking place within an entertainment game executed by an ESE 810 for gameplay gambling event occurrences. The GWE 812 can also communicate the gameplay gambling event occurrences to an RWE 814 that triggers a wager of RC 816 in a gambling game executed by the RWE 814.

In accordance with some embodiments of the invention, the following may occur during use of the gambling hybrid game. The user enters an input that represents an action or decision (850). The ESE 810 signals the GWE 812 with the input decision or action (852). The GWE 812 responds by signaling to ESE 810 with the amount of EE that is consumed by the player action or decision (854). The signaling from the GWE 812 configures a function 806 to control the EE consumption, decay, and/or accumulation.

The ESE 810 then adjusts the EE 804 accordingly (856). The GWE 812 signals the RWE 814 as to the profile of the wager proposition associated with the action or decision and triggers the wager (858). The RWE 814 consumes the appropriate amount of RC 816 and executes the wager (860). The RWE 814 then adjusts the RC 816 based upon the outcome of the wager (862) and informs the GWE 812 as to the outcome of the wager (864).

The GWE 812 signals the ESE 810 to adjust EE to one or more of the EEs of the ESE entertainment game (866). Function 806 of the ESE 810 performs the adjustment of EE 804 (868). The ESE 810 signals the GWE 812 as to the updated status (870). In response, the GWE 812 signals the ESE 810 to update GWC of the entertainment game. The ESE updates the GWC 802 using a function 806 (872).

The following is an example of the above flow in a first person shooter game, such a Call of Duty®, using a gambling hybrid game sequence in accordance with embodiments of the invention.

The process begins by a player selecting a machine gun to use in the game and then fires a burst of bullets at an opponent (850). The ESE 810 signals the GWE 812 of the player's choice of weapon, that a burst of bullets was fired, and the outcome of the burst (852). GWE 812 processes the information received and signals ESE 810 to consume 3 bullets (EE) with each pull of the trigger (854). The ESE 810 consumes 3 bullets for the burst using function 806 (856).

The GWE 812 signals the RWE 814 that 3 credits (RC) are to be wagered to match the three bullets consumed. The RWE 814 then determines the result of the wager and may determine the winnings from a pay table. On a particular pay table (Table Ln-RC), a determination is made by RWE 814 as to the amount of damage that the opponent has sustained. The RWE 814 consumes 3 credits of RC 816 for the wager and executes the specified wager (860). The RWE 814 determines that the player hit a jackpot of 6 credits and returns the 6 credits to the RC 816 (862) and signals the GWE 812 that 3 net credits were won by the player (864).

The GWE 812 signals ESE 810 to add 3 bullets to an ammunition clip (866). ESE 810 adds 3 bullets back to the ammo clip (EE 804) using a function 806 (868). The ammunition may be added by directly adding the ammunition to the clip or by allowing the user to find extra ammunition during gameplay. The GWE 812 logs the new player score (GWC 802) in the game (as a function of the successful hit on the opponent) based on the ESE 810 signaling, and the signals the ESE 810 to add 2 extra points to the player score since a jackpot has been won (870). The ESE 810 then adds 10 points to the player score (GWC 802) given the success of the hit which in this example is worth 8 points, plus the 2 extra points requested by GWE 812 (872). Note that the foregoing example is only intended to provide an illustration of how credits flow in a gambling hybrid game, but is not intended to be exhaustive and only lists only one of numerous possibilities of how a gambling hybrid game may be configured to manage its fundamental credits.

Figure 9:
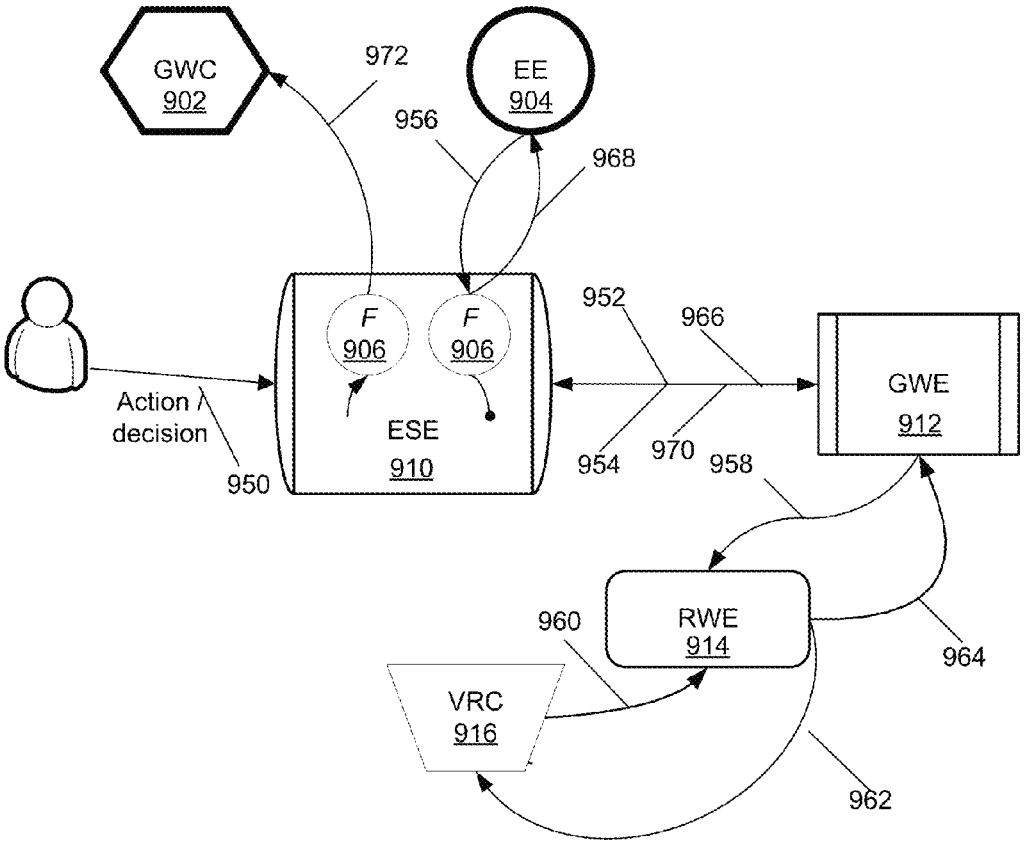
FIG. 9 illustrates a conceptual diagram of the interplay between aspects of a gambling hybrid game in accordance with other embodiments of the invention using Virtual Real World Currency (VRC).

A conceptual diagram that illustrates the interplay between aspects of a gambling hybrid game in accordance with an embodiment of the invention using virtual real world credit (VRC) is illustrated in FIG. 9. As seen in the FIG. 9, substituting VRC in place of RC is effected without impact to the architecture or operation of the gambling hybrid game. The implementation of FIG. 9 is not the only embodiment using virtual currency within a gambling hybrid game, but shows only one permutation of which many could exist.

Similar to FIG. 8, a player's actions and/or decisions can affect functions 906 that consume and/or accumulate GWC 902 and/or EE 904 in an entertainment game executed by an ESE 910 in the process shown in FIG. 9. A GWE 912 can monitor the activities taking place within an entertainment game executed by an ESE 910 for gameplay gambling event occurrences. The GWE 912 can also communicate the gameplay gambling event occurrences to a RWE 914. Unlike the process shown in FIG. 8, RWE 914 triggers a wager of virtual real world credit (VRC) 916 in a gambling game executed by the RWE 914.

For purposes of this discussion, VRC can be thought of as a form of alternate currency, which can be acquired, purchased or transferred, in unit or in bulk, by/to a player, but does not necessarily directly correlate to RC or real currency. As an example, there is a virtual currency called "Triax Jacks", 1000 units of which are given to a player by an operator of a gambling hybrid game, with additional blocks of 1000 units being available for purchase for $5 USD each block. Triax Jacks could be redeemed for various prizes, or could never be redeemed but simply used and traded purely for entertainment value by players. It would be completely consistent with the architecture of the gambling hybrid game that Triax Jacks would be wagered in place of RC, such that the gambling hybrid game could be played for free, or with played with operator sponsored Triax Jacks.

Returning to the process in FIG. 9, the following may occur during use of the gambling hybrid game in accordance with embodiments of the invention. The user enters an input that represents an action or decision (950). The ESE 910 signals the GWE 912 with the input decision or action (952). The GWE 912 responds by signaling to ESE 910 with the amount of EE that is consumed by the player action or decision (954). The signaling from the GWE 912 configures a function 906 to control the EE consumption, decay, and/or accumulation.

The ESE 910 then adjusts the EE 904 accordingly (956). The GWE 912 signals the RWE 914 as to the profile of the wager proposition associated with the action or decision and triggers the wager (958). The RWE 914 consumes the appropriate amount of RC 916 and executes the wager (960). The RWE 914 then adjusts the RC 916 based upon the outcome of the wager (962) and informs the GWE 912 as to the outcome of the wager (964).

The GWE 912 signals the ESE 910 to adjust EE to one or more of the EEs of the ESE entertainment game (966). Function 906 of the ESE 910 performs the adjustment of EE 904 (968). The ESE 910 signals the GWE 912 as to the updated status (970). In response, the GWE 912 signals the ESE 910 to update GWC 902 of the entertainment game. The ESE updates the GWC 902 using a function 906 (972).

Network Based Gambling Hybrid Game

Figure 10:
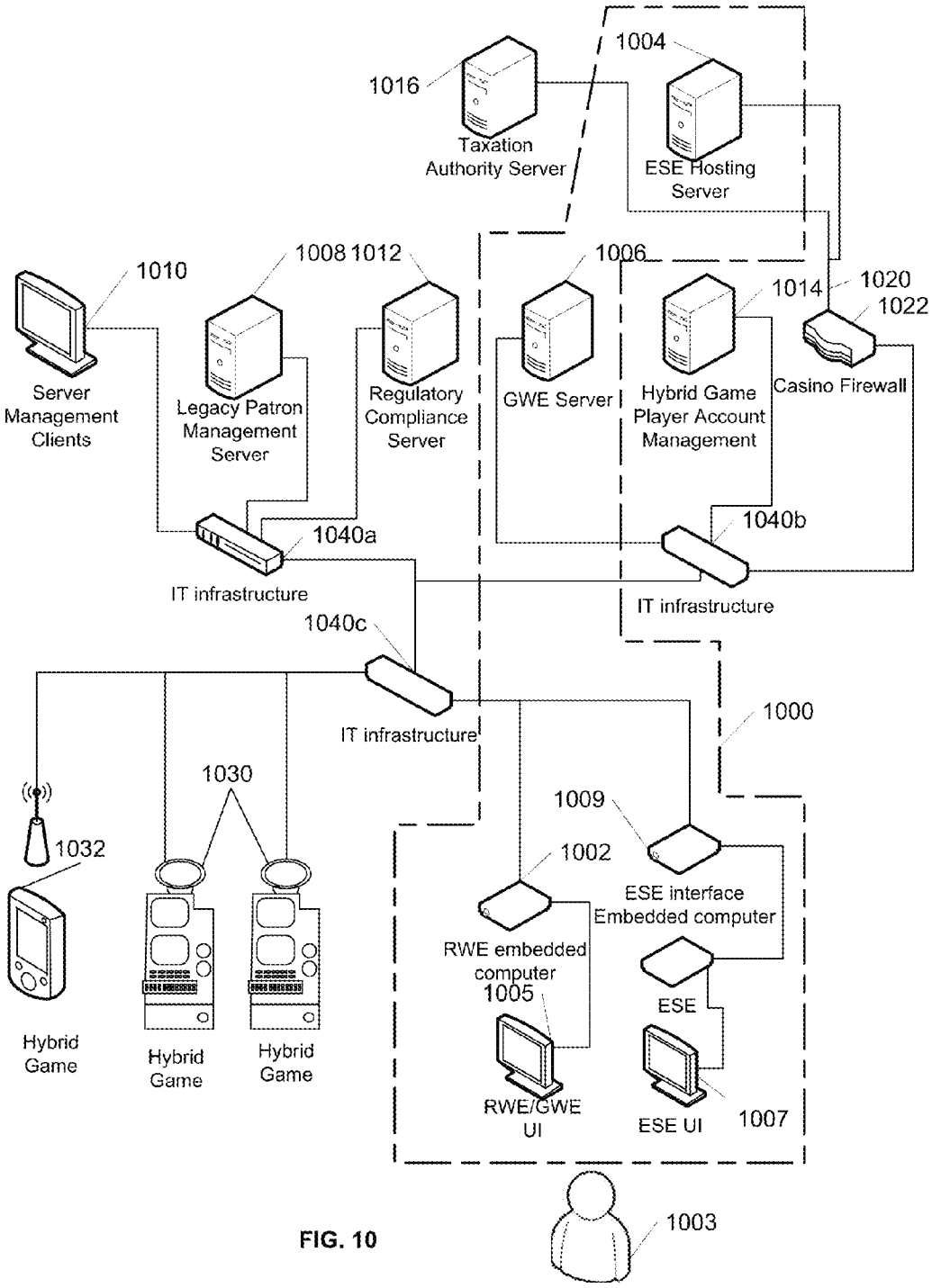
FIG. 10 illustrates a system diagram of an implementation of a network based gambling hybrid game in accordance with another embodiment of the invention.

A system diagram that illustrates an implementation of a network distributed gambling hybrid game with a GWE local server in accordance with embodiments of the invention is illustrated in FIG. 10. In the figure, the gambling hybrid game 1000 includes components, RWE 1002 embedded in a device used as the user interface for player 1003. The device provides both a RWE/GWE user interface 1005 and an ESE user interface 1007 for the player. The ESE is provisioned by an ESE hosting server 1004 via ESE interface 1009, and the GWE is provisioned by GWE server 1006 as indicated by the dashed line. Also pictured in the diagram are a number of other peripheral systems, such as player management 1008, casino management 1010, regulatory 1012, hybrid game player account management 1014, and taxation authority 1016 hosting servers that may be present in such an implementation. FIG. 10 also illustrates various other systems, which may reside outside the bounds of the casino and are connected to the framework via communications network, such as the Internet 1020, depicted by the connection lines past the casino firewall 1022. The end devices utilized for user interfaces for a gambling hybrid game include, but are not limited to, casino electronic game machines 1030 and wireless or portable devices, such as smart phone 1032, personal digital assistants, tablet computers, video gaming consoles or the like. These disparate devices are connected within and without the casino through the casino's information technology structure as illustrated by routers 1040*a*, 1040*b* and 1040*c*. It should be understood that FIG. 10 does not attempt to illustrate all servers and systems to which a gambling hybrid game 1000 might be inevitably be connected, and indeed one might expect there would be others, but rather provides an example of a set of a sub-set of systems which would be present in an exemplary embodiment of an installation.

Figure 11:
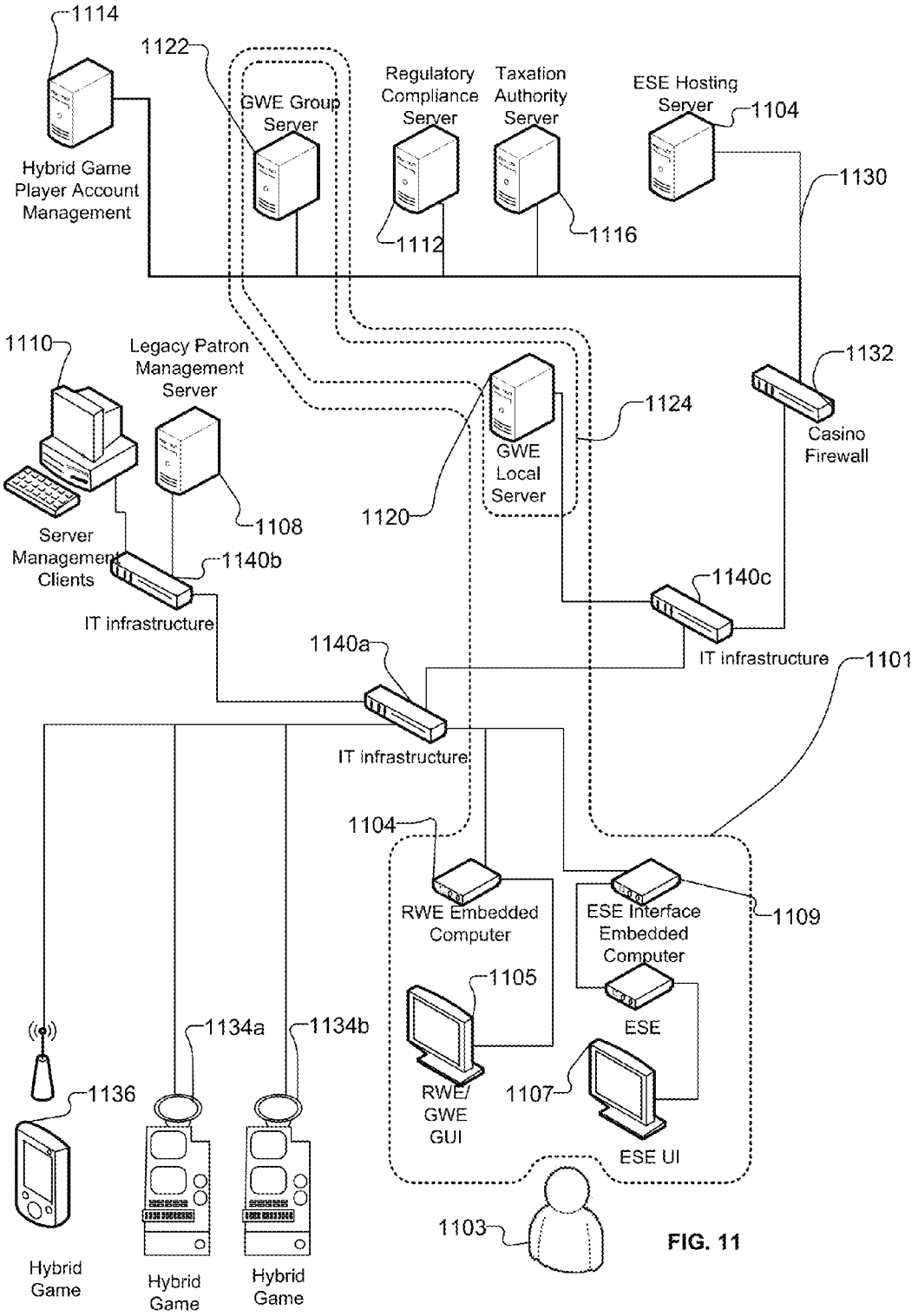
FIG. 11 illustrates a system diagram of an implementation of an Internet based gambling hybrid game in accordance with an embodiment of the invention.

FIG. 11 is a diagram showing another implementation of a gambling hybrid game in accordance with an exemplary embodiment. In the figure, the gambling hybrid game 1101 includes components, RWE 1104 embedded in a device used as the user interface for player 1103. The device provides both a RWE/GWE user interface 1105 and an ESE user interface 1007 for the player. The ESE is provisioned by an ESE hosting server 1104 via ESE interface 1109. Also pictured in the diagram are a number of other peripheral systems, such as player management 1108, casino management 1110, regulatory 1112, hybrid game player account management 1114, and taxation authority 1116 hosting servers that may be present in such an implementation. In the figure, note that the GWE is composed of two sub-components, a local GWE server 1120, and a cloud server 1122 (components within the dash line area 1124). In the figure, certain of the components are located within the bounds of the casino, namely the RWE, the ESE and a portion of the GWE, namely the local GWE server 1120. The Cloud Server GWE 1122 is located in the cloud connected to the casino bounded gambling hybrid game components via communications network such as the Internet 1130 through a firewall 1132. FIG. 11 also illustrates various other systems, which may reside outside the bounds of the casino and are connected to the framework via communications network. The end devices utilized for user interfaces for a gambling hybrid game include, but are not limited to, casino electronic game machines, 1134*a* and 1134*b*, and wireless or portable devices, such as smart phone 1136, personal digital assistants, tablet computers, video gaming consoles or the like. These disparate devices are connected within and without the casino through the casino's information technology structure as illustrated by routers 1140*a*, 1140*b* and 1140*c*. It should be understood that FIG. 11 does not attempt to illustrate all servers and systems to which a gambling hybrid game might be inevitably be connected, and indeed one might expect there would be others, but rather provides an example of a set of a sub-set of systems which would be present in an exemplary embodiment of an installation.

Figure 12:
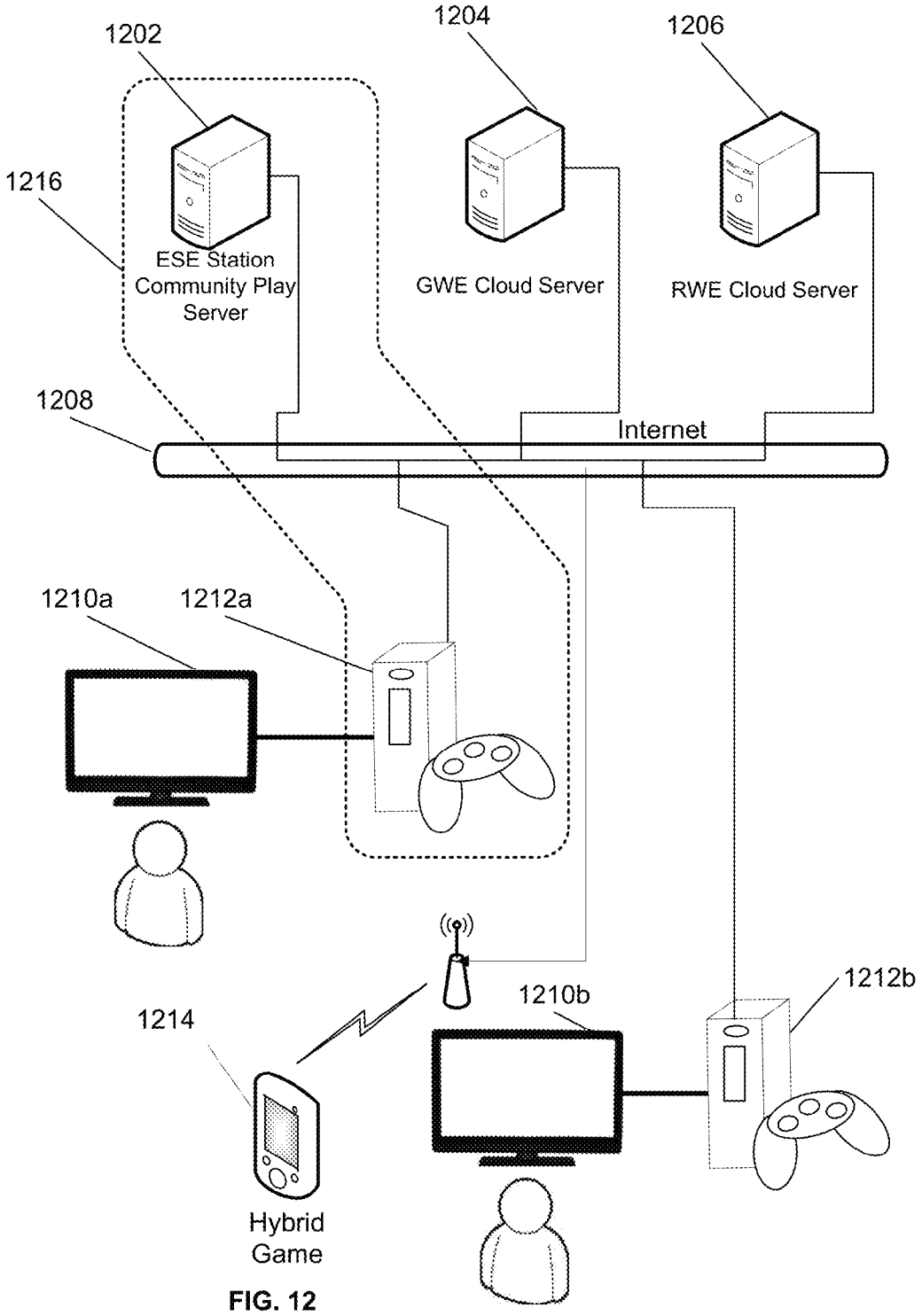
FIG. 12 illustrates a system diagram of an implementation of a cloud based gambling hybrid game in accordance with an embodiment of the invention.

A system diagram that illustrates an implementation of network a cloud based gambling hybrid game over the Internet in accordance with an embodiment of the invention is illustrated in FIG. 12. The system includes an ESE server 1202, GWE server 1204 and RWE server 1206 that each connect to a user interface, 1210*a* or 1210*b*, (such as, but not limited to, a television screen, computer terminal, tablet, touchscreen or PDA) of gambling hybrid games over the Internet 1208. Each gambling hybrid game includes a local ESE 1212*a* or 1212*b* (such as, but not limited to, a video game console or a gaming computer system) that interfaces with a remote ESE server 1002. Processes performed by an ESE 1212*a* services can be performed in multiple locations, such as, but not limited to, remotely on an ESE server 1202 and locally on a local ESE 1212*a*. In addition, a gambling hybrid game may include a Personal Digital Assistant (PDA) 1214 or other type of mobile computing device game coupled to the ESE hosting server 1202, thus providing the opportunity for a player to play a gambling hybrid game on the PDA through a mobile phone or data network.

There are many possible permutations of how a gambling hybrid game could be constructed, with FIGS. 10, 11 and 12 showing only three possible permutations and provided as examples, which are not intended to suggest limitations to the forms of the architecture. Other embodiments include a version where the entire gambling hybrid game is in the cloud with only a client running on player terminal within the bounds of the casino, or a version where the RWE and GWE are casino bound and the ESE exists in the cloud, accessed by a client running on a terminal in the casino.

Processing Apparatuses

Figure 13:
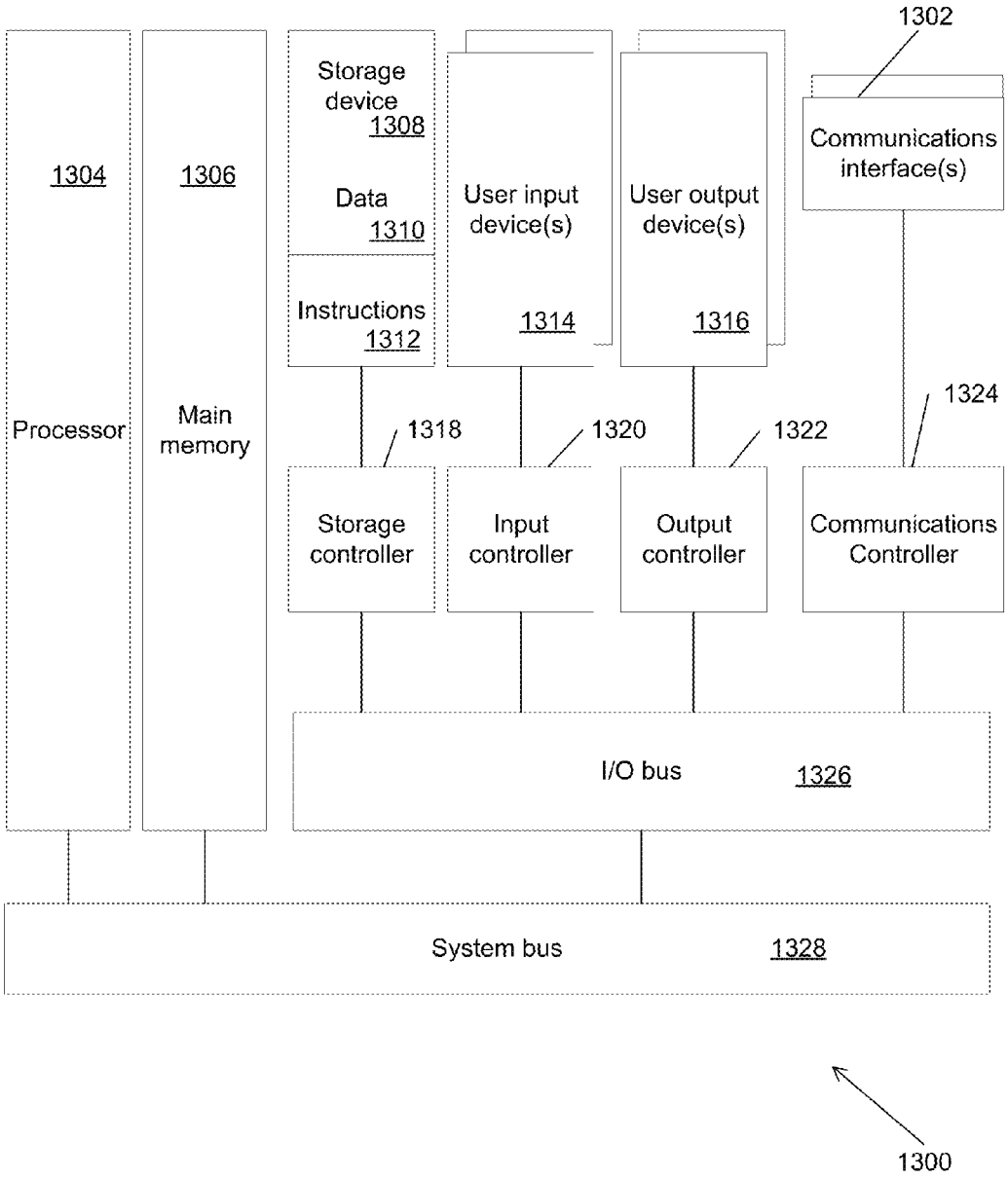
FIG. 13 illustrates a block diagram of components of a device implementing a gambling hybrid game in accordance with an embodiment of the invention.

Any of a variety of processing apparatuses can host various components of a gambling hybrid game in accordance with embodiments of the invention. In accordance with embodiments of the invention, these processing apparatuses can include, but are not limited to, a computing system, a server, a client, a mobile device such as a smartphone, a personal digital assistant or the like, a wireless device such as a tablet computer or the like, an electronic gaming machine, a general purpose computer, a gaming console, a computing device and/or a controller. A processing apparatus that is constructed to implement a gambling hybrid game in accordance with embodiments of the invention is illustrated in FIG. 13. In the processing apparatus 1300, a processor 1304 is coupled to memory 1306 by a bus 1328. The processor 1304 is also coupled to non-transitory machine-readable storage media, such as a storage device 1308 that stores executable instructions 1312 and data 1310 through the system bus 1328 to an I/O bus 1326 through a storage controller 1318. The processor 1304 is also coupled to one or more interfaces that can be used to connect the processor to other processing apparatuses as well as networks as described herein. The processor 1304 is also coupled via the bus to user input devices 1314, such as tactile devices including, but not limited to, keyboards, keypads, foot pads, touch screens, and/or trackballs; as well as non-contact devices such as audio input devices, motion sensors and motion capture devices that the processing apparatus can use to receive inputs from a user when the user interacts with the processing apparatus. The processor 1304 is connected to these user input devices 1314 through the system bus 1328, to the I/O bus 1326 and through the input controller 1320. The processor 1304 is also coupled via the bus to user output devices 1316 such as (but not limited to) visual output devices, audio output devices, and/or tactile output devices that the processing apparatus uses to generate outputs perceivable by the user when the user interacts with the processing apparatus. In accordance with some embodiments, the processor is coupled to visual output devices such as (but not limited to) display screens, light panels, and/or lighted displays. In accordance with particular embodiments, the processor is coupled to audio output devices such as (but not limited to) speakers, and/or sound amplifiers. In accordance with many of these embodiments, the processor 1304 is coupled to tactile output devices like vibrators, and/or manipulators. The processor 1304 is connected to output devices from the system bus 1328 to the I/O bus 1326 and through the output controller 1322. The processor 1304 can also be connected to a communications interface 1302 from the system bus 1328 to the I/O bus 1326 through a communications controller 1324.

In accordance with various embodiments, a processor 1304 can load instructions and data from the storage device into the memory 1306. The processor 1304 can also execute instructions that operate on the data to implement various aspects and features of the components of a gambling hybrid game. The processor 1304 can utilize various input and output devices in accordance with the instructions and the data in order to create and operate user interfaces for players or operators of a gambling hybrid game (such as but not limited to a casino that hosts the gambling hybrid game).

Although the processing apparatus 1300 is described herein as being constructed from a processor and instructions stored and executed by hardware components, the processing apparatus can be composed of only hardware components in accordance with other embodiments. In addition, although the storage device is described as being coupled to the processor through a bus, those skilled in the art of processing apparatuses will understand that the storage device can include removable media such as, but not limited to, a USB memory device, an optical CD ROM, magnetic media such as tape and disks. Also, the storage device can be accessed by processor 1304 through one of the interfaces or over a network. Furthermore, any of the user input devices or user output devices can be coupled to the processor 1304 via one of the interfaces or over a network. In addition, although a single processor 1304 is described, those skilled in the art will understand that the processor 1304 can be a controller or other computing device or a separate computer as well as be composed of multiple processors or computing devices including one or more processors.

Figure 14:
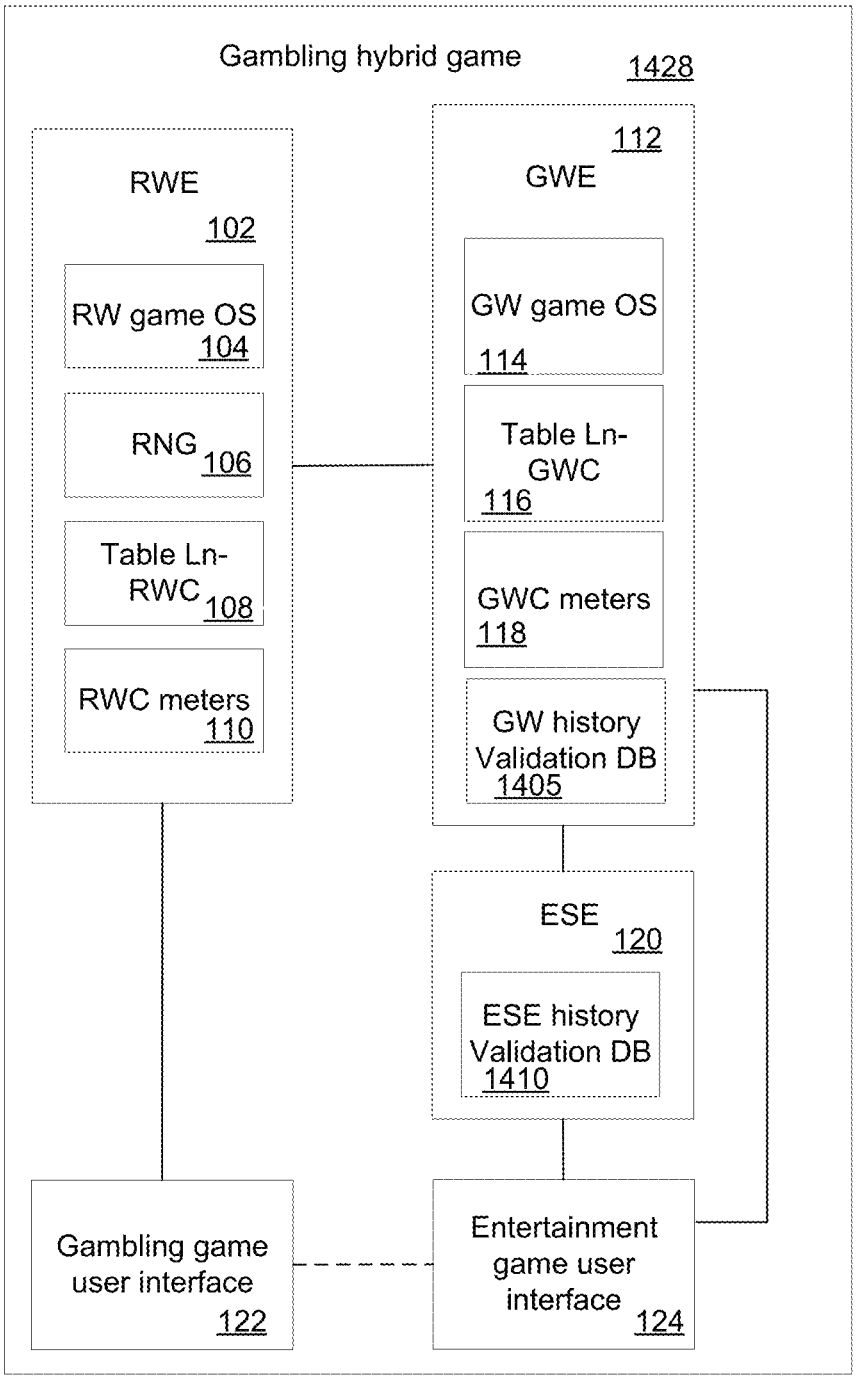
FIG. 14 illustrates a conceptual diagram of components of a gambling hybrid game providing game history validation in accordance with an embodiment of the invention.

Components of a Networked Gambling Hybrid Game that Provides Game History Validation A gambling hybrid game (HyG) system may offer game history validation in accordance with embodiments of the invention for use in resolving disputes between game players and game operators. Components of a gambling hybrid game system game history validation in accordance with an embodiment of the invention are shown in FIG. 14. The gambling hybrid game 1428 may include the same components as gambling hybrid game 128 shown in FIG. 1. In addition, the entertainment software engine (ESE) 120 includes an ESE game history validation database 1410 and a game world engine (GWE) 112 which includes a GWE game history validation database 1405. In various embodiments, the ESE game history validation database 130 stores game history records which may be used to provide game history verification. In many embodiments, the GWE game history validation database stores game history records which have been transmitted to the GWE 112 by the ESE 120 during gameplay of the entertainment game provided by the ESE 120. In accordance with a number of embodiments, the records transmitted to the GWE 112 by the ESE 120 during game play may be transmitted in a manner synchronous to (at the same time as) game history records being stored in the ESE game history validation database 130. Synchronous transmission of the records onto a network based GWE 112 allow for additional validation should the game history of the ESE 120 be called into question.

Figure 15:
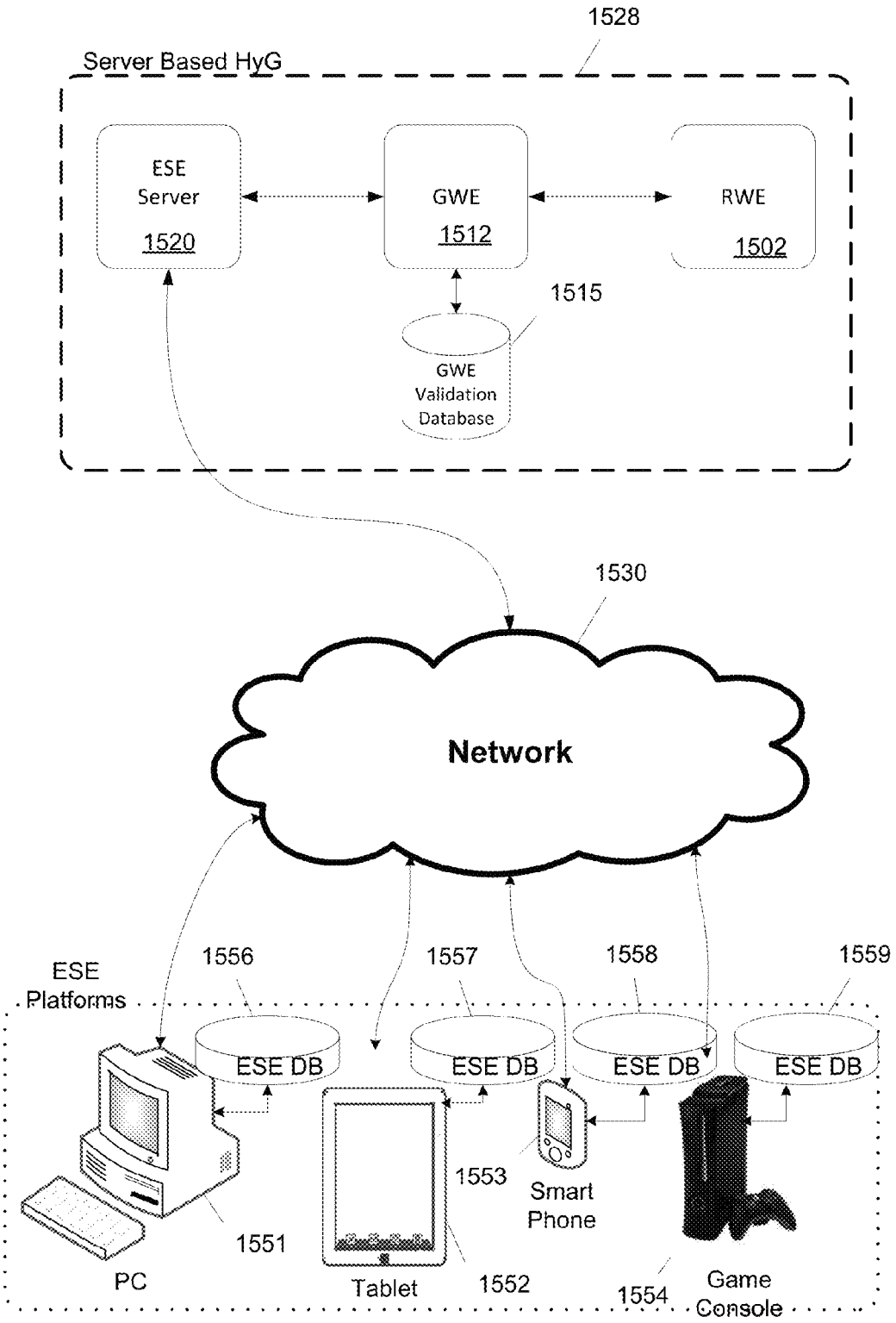
FIG. 15 illustrates a system diagram of a networked gambling hybrid game that provides game history validation in accordance with embodiments of the invention.

The devices that provide a networked gambling hybrid game system having game history validation in accordance with embodiments of the invention are shown in FIG. 15. As illustrated in FIG. 15, ESE client platforms are devices connected to a network 1530. Examples of ESE clients include, but are not limited to personal computer 1551, tablet computer 1552, smart phone 1553, game console 1554, and other gaming devices linked to an ESE server via the network 1530. The client platform may connect to the network 1530 via a "wired" connection, a "wireless" connection, a telephone data network, or any other manner. In accordance with some embodiments, the ESE client platform resides outside of the operator's property. In accordance with embodiments of the invention, the network 1530 may be a wide area network, such as the Internet, a Local Area Network (LAN), or any other type of network for allowing devices to communicate. In accordance with many embodiments, the ESE client platform operates on a LAN within a casino, or other operator's property. In accordance with a number of embodiments, the ESE platform operates in a manner that is out of the direct control of the casino or operator.

A server based gambling hybrid game system 1528 includes an ESE server 1520, a GWE 1512, and an RWE 1502. In many embodiments, the ESE client platform executes software instructions that communicate with the ESE server 1520 to provide an ESE executes the entertainment game. Multiple ESEs of multiple ESE platforms may be managed by the same ESE server in accordance with embodiments of this invention. Each client platform 1551-1554 maintains an ESE game history validation database 1556-1557 to store information used for game history validation. The GWE 1520 manages the entertainment game and triggers gambling in the RWE 1502 based upon one or more triggering events and/or other entertainment game variables that occur in during gameplay of the entertainment game provided by the ESE. A GWE game history validation database 1515 is located on the network and managed by the GWE 1512 that corresponds to each of the ESE client platforms being serviced by the ESE server in accordance with some embodiments of the invention. The RWE 1502 resolves gambling events in a gambling game and may return the results to the GWE 1520. Should a gambling result of a gambling event triggered by game play of the entertainment game provided by the ESE client device be questioned or real credits (RC) owed to the player be questioned by the player, the game history validation records stored in both the ESE client platform(s) and GWE may be used by an operator of the gambling hybrid game, such as a casino, to resolve a question that may arise.

Game History Validation Record

Figure 16:
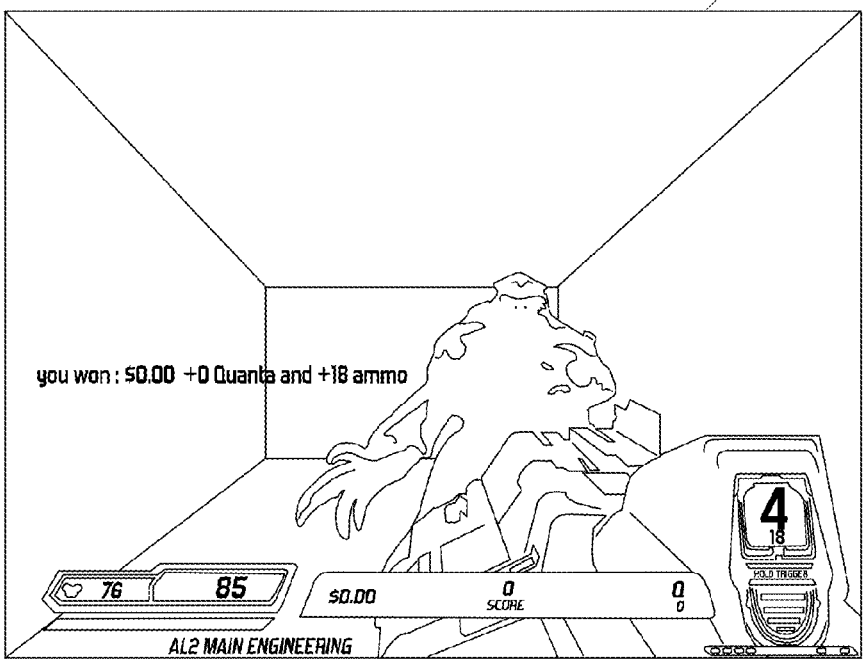
FIG. 16 illustrates a diagram of a validation record for storing game history information in accordance with an embodiment of the invention.

Information about game play can be maintained for the purpose of performing game history validation for a gambling hybrid game. An example of a game history validation record maintained by a gambling hybrid game that can be used to perform game history validation in accordance with embodiments of the invention is shown in FIG. 16.

In accordance with some embodiments, a game history validation record 1600 augments game history records that may be required by the operator and/or regulatory agencies. A game history validation record 1600 has two primary components: a header 1605, and an image 1610. The image 1610 is a screen capture of the ESE client platform display. The header 1605 is a text record, which includes but is not limited to the following information: a hash, player ID, player session, game session ID, sequence ID, device ID, time/date stamp, IP address of ESE client platform, client software version. The hash is a fixed length value, which is mapped from a larger variable length record by a hash function. Given the same input and same hash function, the resultant hash is repeatable and may be used for file comparison. In various embodiments, the hash is a mapped representation of the screen capture image.

In many embodiments, it may not be practical to transmit the entire game history validation record 1600 including the header and screen image to the GWE in real time due to bandwidth limitations of the network. In order to provide the game history validation record 1600 to the GWE in a timely manner, only the header 1605 of a game history validation record 1600 is transmitted to the GWE in real time and the entire record 1600 including the header 1605 and the corresponding image 1610 are stored in the ESE game history validation database in real time. As previously noted, the header includes a hash which is representative of the image stored in the ESE game history validation database in accordance with some embodiments. In numerous embodiments, the depth of the game history validation database (or number of historical records stored by the ESE and/or GWE) may be dependent upon operator policy and/or regulatory requirements.

While a particular game history validation record is described above with reference to the FIG. 16. One skilled in the art will recognize that different data structures and data formats may be used to store game history validation information without departing from embodiments of this invention.

Process for Storing Game History Validation Information

Figure 17:
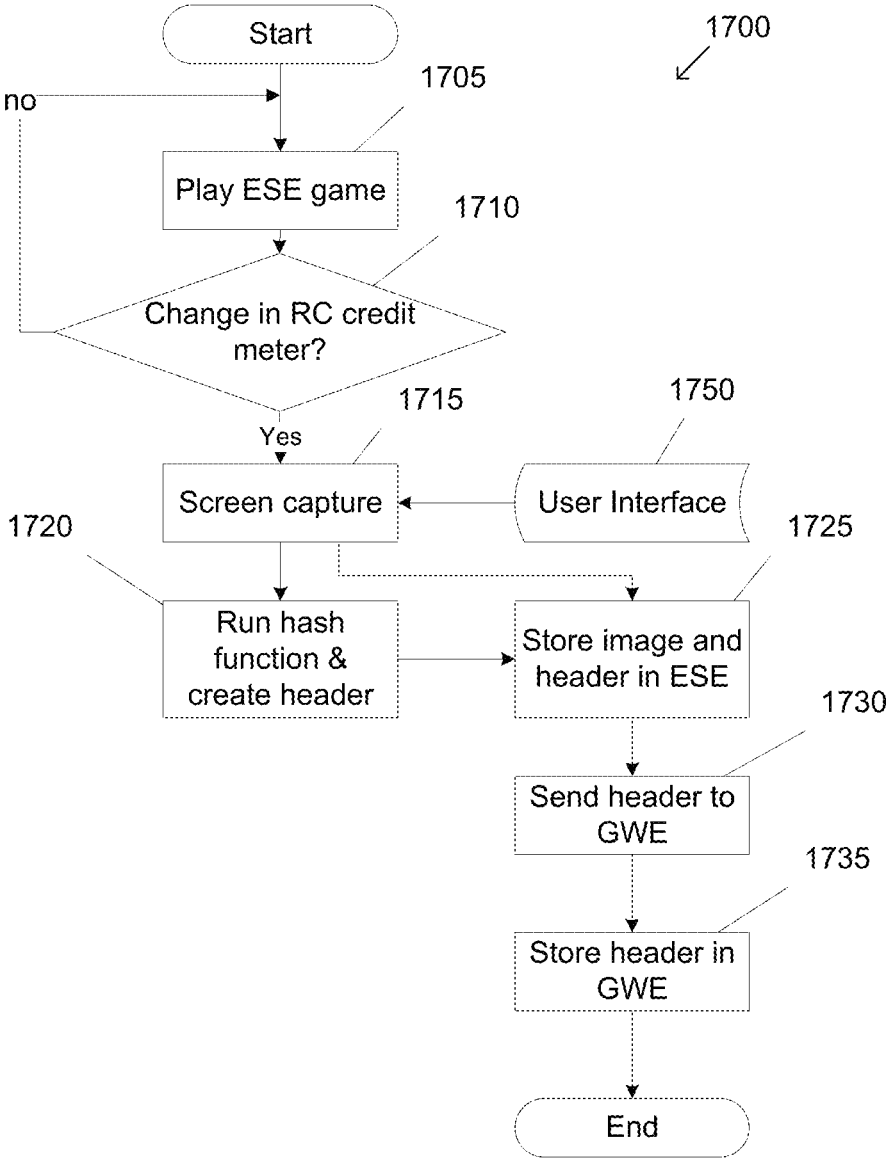
FIG. 17 illustrates a flow diagram of a process for storing game history validation information in accordance with an embodiment of the invention.

Game history validation information stored during game play can be used to perform game history validation. A process performed by the ESE and GWE to store game validation information in accordance with embodiments of the invention is shown in FIG. 17.

In accordance with many embodiments of the invention, process 1700 operates in the following manner. An ESE of the gambling hybrid system provides an entertainment game (1705). During game play, the ESE and/or GWE monitor gameplay of the entertainment and/or gambling game for a triggering event such as, but not limited to, a change in the RC credit meter (1710). If a triggering event is detected, the ESE is triggered to take a screen capture (1715) from the user interface (1750). The screen capture may include current game state, as well as RC values displayed to the player in accordance with some embodiments. The captured image may also include, but is not limited to, other information such as game score, game world credit (GWC), intermediate credits earned by the player's commitment of real credits to wagers and then used to purchase in game objects for the entertainment game, or other in-game resources in accordance with a number of embodiments of the invention.

The ESE applies a hash function to the captured image data to create a hash. Other information to be inserted into the header is then retrieved. The information may include, but is not limited to, a player ID, a player session ID, a Game session ID, a device ID, a time stamp, an IP address of the client platform, and the client version of the software for providing the gambling hybrid game. The information is then used to create a header for the game validation record (1720). Information in the header may include, but is not limited to, hash, player ID, player session, game session ID, sequence ID, device ID, time/date stamp, IP address of ESE client, and client software version.

In many embodiments, the entire game history validation record including the header and the screen capture image file are stored by the ESE client (1725). The header of the game history validation record is transmitted to the GWE (1730). Once the header is received by the GWE, the header may be stored in a game history validation database by the GWE (1735).

Although a specific process for storing game validation information in a gambling hybrid system is described above with reference to FIG. 17, any of a variety of processes may be used in accordance with various embodiments of the invention.

Figure 18:
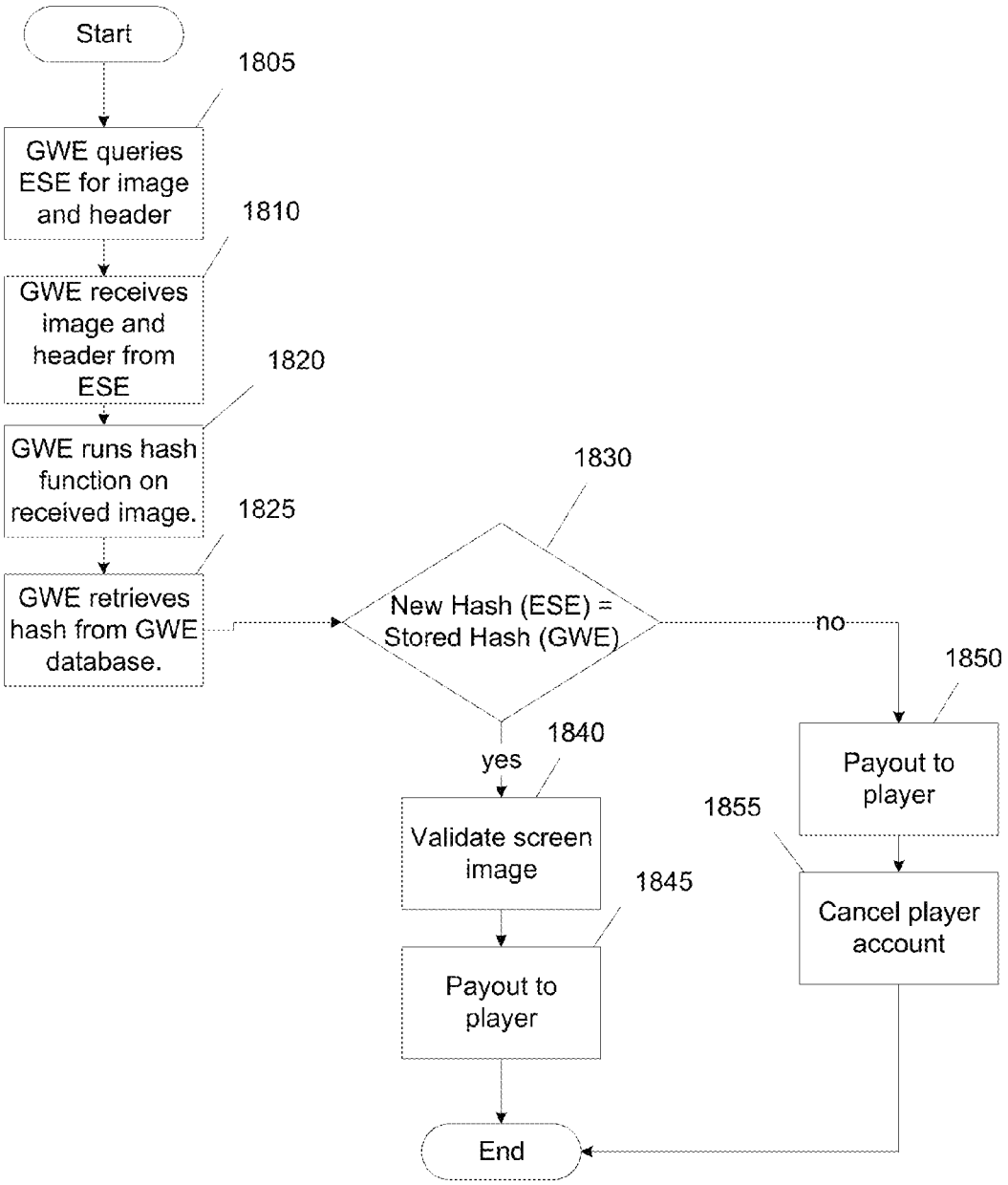
FIG. 18 illustrates a flow diagram of a process for performing a validation of game history information in accordance with an embodiment of the invention.

In accordance with embodiments of the invention, the need may arise to verify the game history and/or the RC which is to be paid out to a player based on game play. An example of a situation in which game verification may be needed is when a player claims a win from the RWE was not properly credited to the player's account and/or was not paid out properly. A process that performs game history validation for networked hybrid games to validate or invalidate a player's claim in accordance with embodiments of this invention is shown in FIG. 18.

In accordance with various embodiments of the invention, process 1800 is performed if there is a question regarding gambling hybrid game history. In process 1800, the GWE queries the ESE for one or more game history validation records stored in the ESE (1805). The game validation record stored in the game history validation database of the ESE includes both an image and a header. The GWE receives one or more game history validation records including the image and the header from the ESE in response to the query (1810). The GWE applies a hash function to the image in the game history validation record received from the ESE (1820). The application of the hash function to the image results in a validation hash for the sent image. The GWE also retrieves the corresponding header of the record including the hash stored in the GWE game history validation database (1825).

In accordance with some embodiments, the GWE compares the validation hash generated from the image in the game validation record received from the ESE to the stored hash from the header stored in the GWE game history validation database (1830). If the two hash values are found to be equal, the screen image is validated (1840) and the casino/operator pays out any credit owed to the player (1845). If the hashes do not match, the game history is not validated. In accordance with some embodiments, the operator/casino pays out the claim to the player (1850) in response to the game history not being validated, and subsequently closes the player's account due to the unverifiable claim made by the player (1855).

Although a specific process for validating game history for a gambling hybrid system is described above with reference to FIG. 18, any of a variety of processes may be used in accordance with various embodiments of the invention.

Example of Network Game Play of a Gambling Hybrid Game With a Game History Validation Process In accordance with several embodiments of the invention, a gambling hybrid game includes a first person shooter game as an entertainment game and one or more gambling games provided based on gameplay of the first person shooter game. The gambling hybrid game is played over a network and includes game history validation for gambling hybrid games as previously described. A conceptual diagram of the components and the information passed between the components to provide the gambling hybrid game with game history validation in accordance with an embodiment of the invention is shown in FIG. 19.

Figure 19:
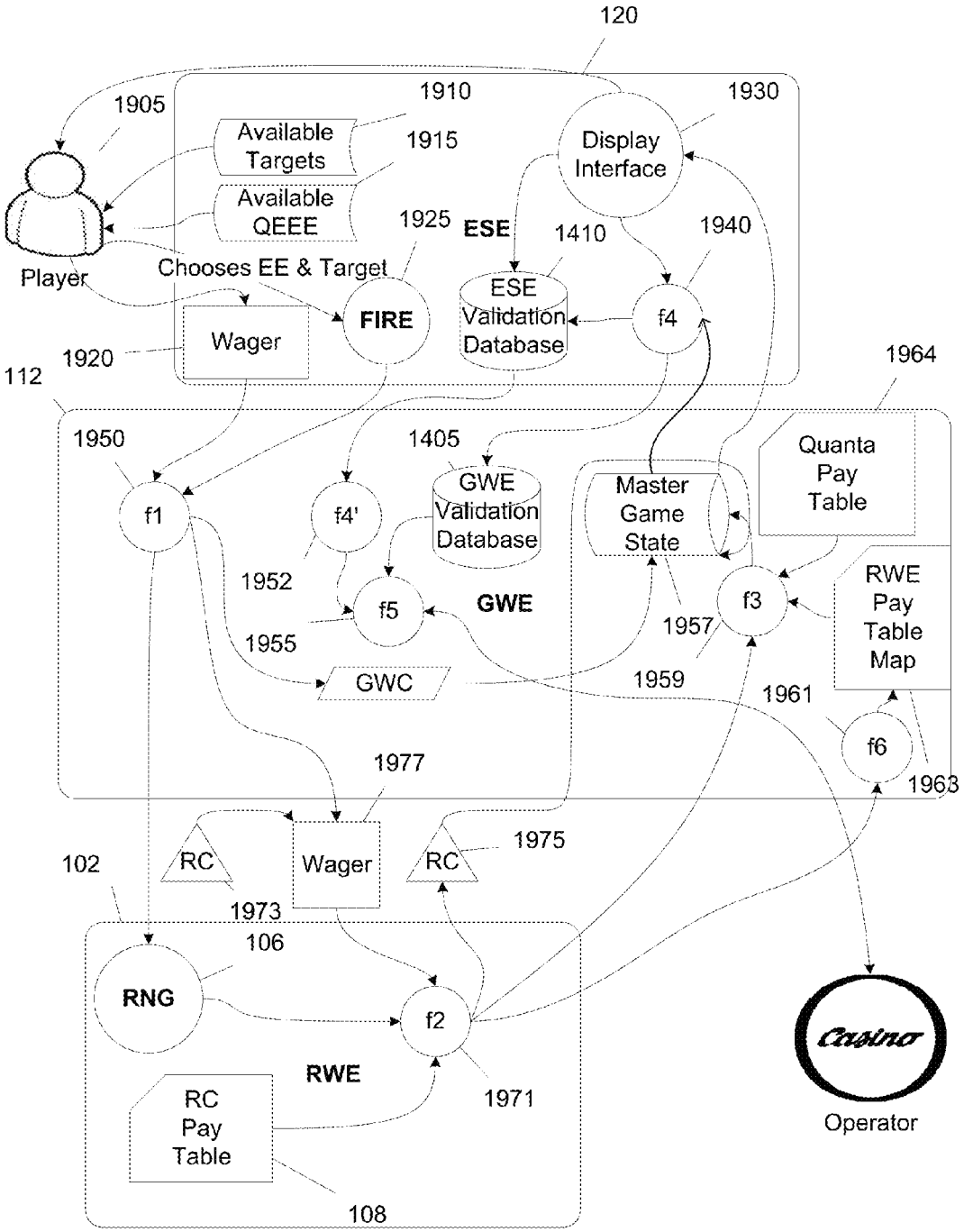
FIG. 19 illustrates a diagram showing components of a gambling hybrid game and the information passed between the components to provide game history validation in accordance with an embodiment of the invention.

In FIG. 19, ESE 120 is provided by executing software on a client device and/or executing software on an ESE server, the GWE 112 can be provided by a GWE server in communication with the ESE 120, and the RWE 102 can be provided by an RWE server that communicates with the GWE 112 and/or ESE 120. Gameplay of the gambling hybrid game begins by the player 1905 selecting a wager denomination 1920 to play in the gambling hybrid game. Once play of the entertainment game commences, the player 1950 receives information from the ESE 120 regarding available targets 1910. Examples of targets include, but are not limited to, monsters, ogres, zombies, enemy players, and the like. The player 1905 also receives information about available Quanta enabled enabling elements (QEEE) 1915 that the player may play against the targets. Examples of QEEE are given below with reference to a Quanta catalog shown FIG. 21. The player 1905 instructs the ESE 120 by choosing one or more EE (or QEEE) to play, and choosing to attack or, "FIRE" a weapon 1925. An example of a screen image of a weapon firing is given with reference to FIG. 20. Once the player has selected an EE and a target, the player submits their play to the GWE by invoking the fire function. As an example, the fire function may be invoked by actuating a "Fire" or "Shoot" button, which is part of the user interface 1925. The actuating of the fire or shoot button may be performed by one more actions including, but not limited to, pulling a trigger on a firearm type controller associated with the game, and clicking on a button on a keyboard of a PC depending on the particular embodiment of the invention.

In several embodiments, by invoking the fire function, the player 1905 invokes function f1 1950 in the GWE 112 and commits to a gambling proposition. Function f1 1950 handles the entertainment game action in response to the input. The response can include, but is not limited to, one or more of the following processes: verifying that the target position(s) and selected ammunition/EE is available to fire, prior to awarding GWC and triggering a wager in the RWE; determining if the played EE hits or misses any of the targets available and computing the points or GWC earned based factors that may include the number of hits and/or misses, weapon and/or ammunition used, which target was hit, damage to target, and/or other parameters, generating GWC that is summed with the existing GWC and updating the GWC of the player in the master game state 1957; updating the master game state 1957 in the GWE 112 after the play has been verified; determining the amount of real credits (RC) to be wagered in a gambling event based upon inputs including, but not limited to, type of EE used (for example a grenade launcher may result in a larger wager than a rifle) and wager denomination selected by the player where the specific formulae for wager amount may depend on additional factors, including but not limited to, casino rules, regulatory rules, and other input and/or requirements; and verifying conditions are met to trigger a gambling event (for example adequate time has elapsed between wagers, per regulatory requirements), and subsequently triggering the random number generator (RNG)/gambling, in the RWE.

The function f1 1950 in GWE 112 triggers a gambling event in the RWE 102 by passing wager information 1977 to function f2 1971 in RWE 102. The wager information 1977 may also include RC 1973 added to the wager by the player. The RWE 102 resolves the gambling event by performing function f2 1971. The function f2 1971 receives inputs including, but not limited to, the amount of RC bet or the wager 1977, a result from the RNG 106, and a pay table 108. Based on the RNG the result from RNG 106, a pay table look-up performed on pay table 108, and the amount of RC wagered 1977, f2 1971 computes the amount of RC, if any, won by the player. RC won 1975 is fed back to the master game state 1957 in the GWE 1402 and displayed to the player via the display interface. In some embodiments, the ESE 120 display interface 1930 may integrate the RWE meter values, and amount of RC won. In some embodiments, this information may be presented via an overlay of the display interface 1930.

In many embodiments, function f3 1959, performed by the GWE 112 includes an algorithm to determine how much, if any, Quanta is to be awarded based on the outcome of the gambling proposition. In many embodiments, Quanta may be defined as an intermediate in-game user resource and/or currency that may be used to purchase or enable in-game resources, such as enabling elements (EE) or actionable elements (AE) that change the state of the entertainment game and/or offer the player benefits or advantages in the entertainment game. Quanta may be awarded to the player as a result of the outcome of wagers made to the RWE. A winning wager may result in Quanta being added and a losing result or push may not result in Quanta being added in accordance with some embodiments. The algorithm for awarding Quanta in the game may vary from game to game and/or from operator to operator depending on the particular implementation of the gambling hybrid game.

In the illustrated embodiment, function f3 1959 receives the output of f2 1971 and the inputs of the function f2 1971 including wager 1977, the results of RNG 106, RC pay table 108, Quanta pay table 1963, and the output of function f6 1961 (described below). The algorithm to determine how much, if any, Quanta to award is generated by function f3 1958 and may vary significantly, based upon factors including, but not limited to, desired player experience, game personality desired, how much influence the outcome of the gambling game may have on the entertainment game. In accordance with some embodiments, the amount of Quanta awarded is inversely proportional to the gambling result, potentially allowing a player doing poorly in the gambling game to gain advantage in the entertainment game. The Quanta awarded by function f3 1959 can be summed with existing Quanta and stored with the master game state 1957 for future use by the player. The amount of Quanta available, along with a display of items that may be purchased with the Quanta is displayed to the player via the display interface 1930 in the ESE 120. In some embodiments the Quanta result may be negative and the players available Quanta is reduced when the negative result is summed with the existing Quanta balance.

In accordance some embodiments, a function f6 1961 is invoked in the GWE 112. The output from function f2 1971 along with inputs the inputs of f2 1971 including, but not limited to, the results of RNG 106 and RC pay table 108 in the RWE, the function f6 1961 creates a RWE pay table map 1963 are received by f6 1961 and used to create a RWE pay table map 1963 that serves as an input to function f3 1959 to indicate if a near miss has taken place in the RWE. A near miss may be defined as a result from RNG 106 that nearly provided a large payout. An example of a near miss in the slot machine would be a four reel slot machine, where three of the jackpot symbols are on the pay line, and the fourth symbol hit just above or below the pay line. In the case of a near miss in the RWE 102, a Quanta bonus may be paid out by function f3 1959, as a constellation prize. Also, the GWE 112 may pass a message to the user, via the display interface 1930, informing them of the near miss and that the player has received a Quanta bonus.

In accordance with a number of embodiments, the amount of Quanta awarded is not directly tied to the gambling win in any direct manor. Quanta is awarded from a Quanta pay table 1964 that is in not linked to the RWE RC pay table 1963. This may result in a random Quanta distribution, with respect to RC payouts from the RWE.

Figure 20:
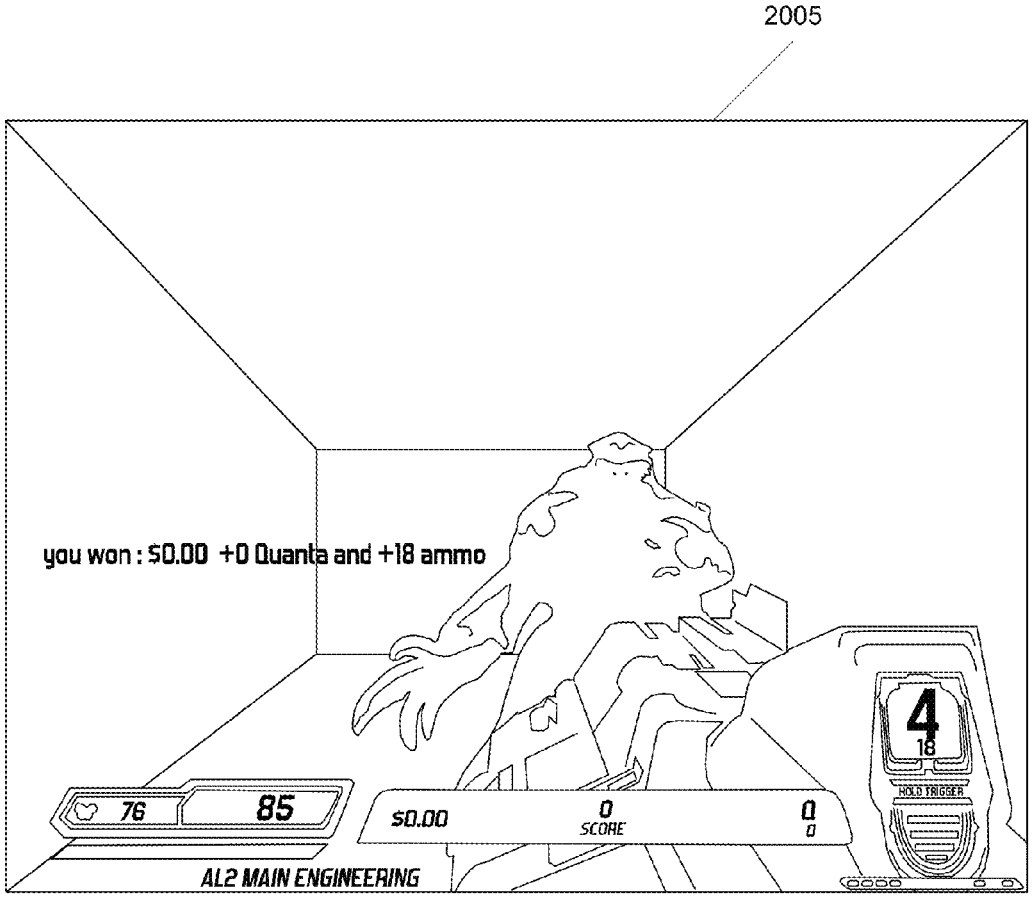
FIG. 20 illustrates a screen image from a first person shooter entertainment game provided by a gambling hybrid game in accordance with an embodiment of the invention.

In many embodiments, the master game state 1957 passes information including, but not limited to, the state of the game board or field of play; current score (GWC); opponents current score; Quanta available; QEEE available; wager denomination; and current RC balance to the ESE 120 and the information is displayed to the player, via the display interface 1930 in the following manner. The master game state 1957 passes information including, but not limited to, the meter values from the RWE to a function f4 1940 in the ESE 120. A change in the RC meter value(s) may cause function f4 1940 to trigger a capture of a screen image from the ESE display interface 1930 (an example of a screen display is shown in FIG. 20). The screen image can be used for game history validation. Additionally, function f4 1940 can include a hash function that receives a captured screen image as an input and outputs a hash. The hash is stored as part of a header of game validation record. The game history validation record can also store the captured screen image. The game history validation record can be stored in the ESE game history validation database 1410. Function f4 1940 can transmit the game history validation record or at least the game history validation record header including the hash to a corresponding GWE game history validation database 1405 in GWE 112.

In accordance with some embodiments, a game history validation record including the header and the captured image cannot be transmitted in real time, or game time, due to bandwidth limitations of the network or other network limitations. Thus, only the header of the game history validation record that typically utilizes much lower bandwidth is transferred in real time during game play to GWE validation database 1405 for storage.

In the case that it is necessary to validate the game history due to a player complaint; an operator or regulatory audit; etc., the operator initiates a game history validation via function f5 1955 in the GWE 112. During a game history validation session, function f5 1955 invokes function f4' 1952. Function f4' downloads the full game history validation record from the ESE validation database 1410 in the ESE 120, and applies a hash function (identical to the f4 1940 hash function applied in the ESE) to captured screen image in the game history record to generate a validation hash. Function f5 1955 compares the validation hash (or multiple hash values from multiple frames) for the captured image downloaded from the ESE game history validation database 1410, with the hash stored during game play in the GWE game history validation database 1405. Function f5 1955 then returns the results of the game history validation to the Casino, operator or regulator, for appropriate action.

Although a specific process for providing a gambling hybrid game and performing a validation of the game history of gambling hybrid system is described above with reference to FIG. 19, any of a variety of processes may be used in accordance with various embodiments of the invention.

An example of a captured screen image in accordance with an embodiment of the invention of the invention is shown in FIG. 20. The captured screen image 2005 from a first person shooter entertainment game shows the present state of the gambling hybrid game, including but not limited to, a current weapon in use, available targets, ammunition available, RC won, Quanta won, ammunition won, health won, RC balance, game score (GWC), and Quanta balance.

In various embodiments, a Quanta selector user interface may be used to purchase (QEEE). A screen image including a Quanta selector in accordance with an embodiment of the invention is shown FIG. 21. Game display 2105 includes a Quanta catalog 2110 in a portion of the display. The Quanta catalog 2110 is used by a player in a first person shooter to obtain game resources. The Quanta™ catalog 2105 shows the player's current Quanta balance, along with a selection of items including, but not limited to, special weapons, med kits (to increase the controlled entities (CE) health), and special ammunition. If an item is purchased from the Quanta catalog, the cost of the item is deducted from the players Quanta balance, and the item is added to CE's inventory, where the item may be used by the CE.

Figure 21:
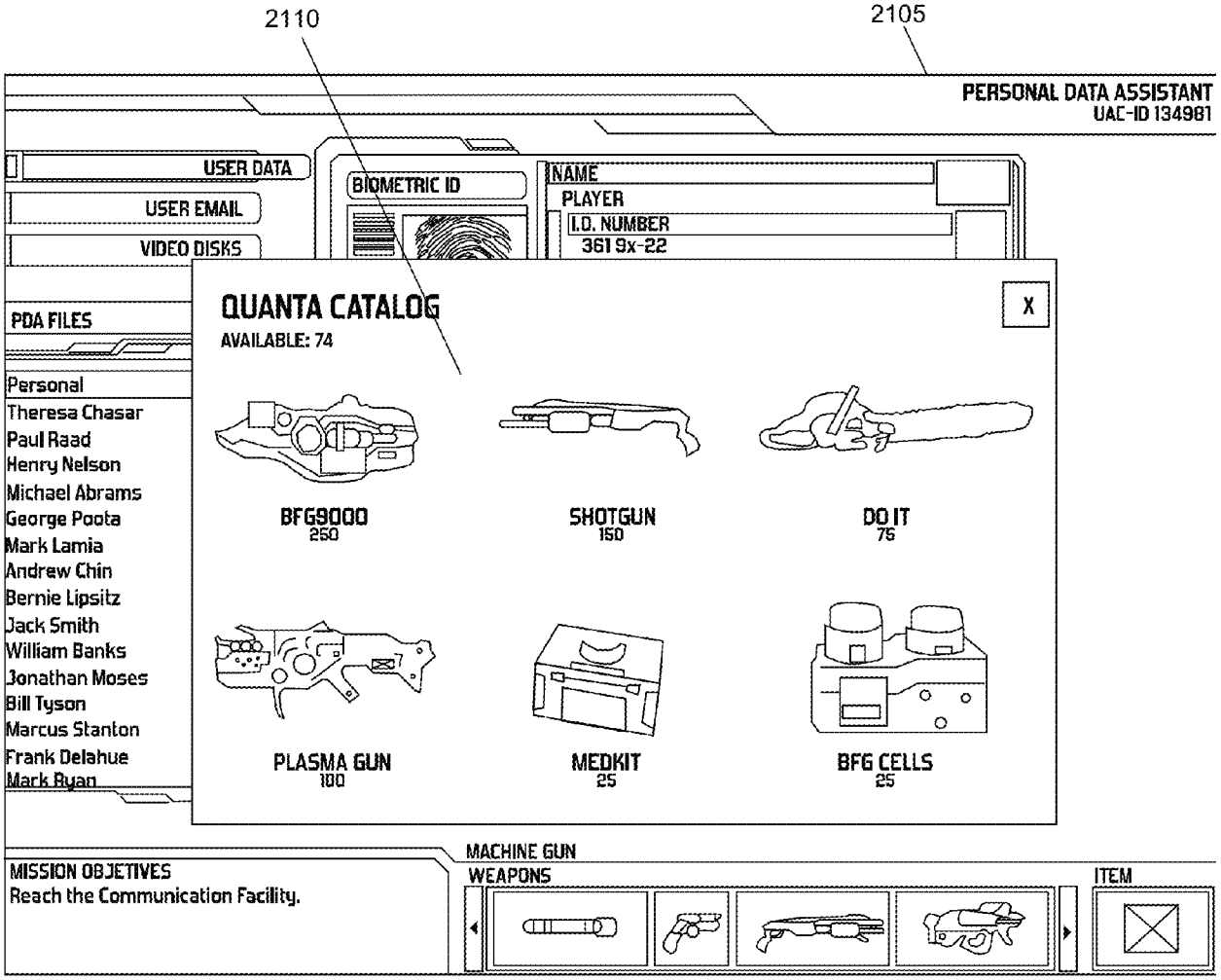
FIG. 21 illustrates a screen image that includes a Quanta catalog from a first person shooter entertainment game provided by a gambling hybrid game in accordance with an embodiment of the invention.

One skilled in the art will recognize the images in FIGS. 20 and 21 are only examples of screens for particular games and the screen image and the provision of a Quanta selector in a screen image may differ based many factors including, but not limited to the entertainment and gambling games provided; the device resources available, and designer preferences without departing from this invention.

Embodiments of Gambling Hybrid Games that Provide Game History Validation

In accordance with some embodiments, a networked gambling hybrid game having on a tile-matching puzzle video game, similar to Tetris™, as the entertainment game utilizes a game history validation process to store real time screen captures and headers (including hash) in the ESE while transmitting the header to the GWE for storage in order to provide a verifiable game history as previously described.

In accordance with a number of embodiments, a gambling hybrid game having a maze type arcade or video game, similar to Pac-Man™, as the entertainment gamey utilizes a game history validation to store to store real time screen captures and headers (including hash) in the ESE while transmitting the header to the GWE for storage in order to provide a verifiable game history as previously described.

In accordance with a number of embodiments, a gambling hybrid game having a space shooter arcade or video game, similar to Galaga™ utilizes a game history validation process to store real time screen captures and headers (including hash) in the ESE while transmitting the header to the GWE for storage in order to provide a verifiable game history as previously described Although certain specific features and aspects of a gaming system have been described herein, many additional modifications and variations would be apparent to those skilled in the art. For example, the features and aspects described herein may be implemented independently, cooperatively or alternatively without deviating from the spirit of the disclosure. It is therefore to be understood that a hybrid gaming system may be practiced otherwise than as specifically described. Thus, the foregoing description of the hybrid gaming system should be considered in all respects as illustrative and not restrictive, the scope of the claims to be determined as supported by this disclosure and the claims' equivalents, rather than the foregoing description.

What is claimed is:

1. A gaming system for providing a gambling hybrid game that includes an entertainment game and a gambling game, comprising:

a processing device constructed to:

execute the entertainment game, wherein the entertainment game generates entertainment game information;

communicate, to a game world server, a signal including a trigger of a wager of game world credits triggered by a player's action during the player's skillful play of the entertainment game;

obtain game history information in response to a trigger event, wherein the game history information includes current entertainment game information;

store the game history information in a memory of the processing device;

communicate, to the game world server, a signal including a portion of the game history information;

receive, from the game world server, a signal including a request for the game history information wherein the game history information is verified by the game world server;

receive, from the game world server, a signal including a result of a wager of game world credits triggered by the player's action during the player's skillful play of the entertainment game;

display the result of the wager of game world credits triggered by the player's action during the player's skillful play of the entertainment game;

display an amount of intermediate in-game user resources that may be used to purchase or enable in-game resources based on the result of the wager of game world credits; and communicate, to the game world server, a signal including the game history information stored in the memory of the processing device, in response to the request;

a real world server constructed to:

receive, from the game world server, a signal including a request for a resolution of a wager of game world credits triggered by the player's action during the player's skillful play of the entertainment game;

determine the result of the wager of game world credits triggered by the player's action during the player's skillful play of the entertainment game using a random number generator and generate gambling game information; and communicate, to the game world server, the signal including the result of the wager of game world credits triggered by the player's action during the player's skillful play of the entertainment game; and the game world server, connected to the processing device via a network and connected to the real world server via a communication link, constructed to:

continuously monitor the processing device for the signal including the trigger of the wager of game world credits triggered by the player's action during the player's skillful play of the entertainment game;

receive, from the processing device, the signal including the trigger of the wager of game world credits triggered by the player's action during the player's skillful play of the entertainment game;

determine whether to trigger the wager based on the signal including the trigger of the wager of game world credits triggered by the player's action during the player's skillful play of the entertainment game;

communicate, to the real world server, the signal including the request for the resolution of the wager of game world credits triggered by the player's action during the player's skillful play of the entertainment game;

receive, from the real world server, the signal including the result of the wager of game world credits triggered by the player's action during the player's skillful play of the entertainment game;

calculate the amount of intermediate in-game user resources that may be used to purchase or enable in-game resources based on the result of the wager of game world credits;

receive, from the processing device, the signal including the portion of the game history information;

store the received portion of the game history information in a memory of the game world server;

receive a request to validate the game history;

communicate, to the processing device, the signal including the request for the game history information in response to receiving the request to validate the game history;

receive, from the processing device, the signal including the game history information;

retrieve the portion of the game history information in the memory of the game world server;

verify the game history information received from the processing device based upon the retrieved at least a portion of the game history information; and communicate, to the processing device, the signal including the result of the wager of game world credits triggered by the player's action during the player's skillful play of the entertainment game and the amount of intermediate in-game user resources when the game history information is verified, and cancel a player account when the game history is unverifiable.

2. The gaming system of claim 1, wherein the game world server is further constructed to:

receive, from the processing device, a signal including the entertainment game information;

detect a triggering event in the entertainment game information; and communicate, to the processing device, a signal including the request to obtain game history information.

3. The gaming system of claim 1, wherein the game world server is further constructed to:

receive, from the real world server, a signal including the gambling game information;

detect a triggering event in the gambling game information; and communicate, to the processing device, a signal including a request for game history information.

4. The gaming system of claim 1, wherein the game history information is a game history record including a header and a captured screen image of a user interface provided by the processing device during the entertainment game.

5. The gaming system of claim 4, wherein the processing device is further constructed to:

capture a screen image from a user interface;

generate image information from the captured screen wherein the image information uniquely identifies the captured screen image;

insert the image information into the header for the game history record; and generate the game history record including the header and the captured screen image.

6. The gaming system of claim 5, wherein the portion of the game history information is the header of the game history record.

7. The gaming system of claim 6, wherein the processing device is further constructed to apply a hash function to the captured screen image to generate a hash that is used as the image information.

8. The gaming system of claim 7, wherein the game world server is further constructed to:

apply the hash function to the captured screen image in the game history record provided by the processing device in response to a request to generate a verification hash;

compare the hash in the header stored to the verification hash; and verify the game history in response to a matching of the verification hash and the hash in the header stored.

9. A gaming system for providing a gambling hybrid game that includes an entertainment game and a gambling game, comprising:

a processing device constructed to:

execute the entertainment game, wherein the entertainment game generates entertainment game information;

communicate, to a game world server, a signal including a trigger of a wager of game world credits triggered by a player's action during the player's skillful play of the entertainment game;

obtain game history information in response to a trigger event, wherein the game history information includes current entertainment game information;

store the game history information in a memory of processing device;

communicate, to the game world server, a signal including a portion of the game history information;

receive, from the game world server, a signal including a request for the game history information wherein the game history information is verified by the game world server;

communicate, to the game world server, a signal including the game history information stored in the memory of the processing device, in response to the request;

receive, from the game world server, a signal including a result of a wager of game world credits triggered by the player's action during the player's skillful play of the entertainment game calculated using a random number generator;

display the result of the wager of game world credits triggered by the player's action during the player's skillful play of the entertainment game; and display an amount of intermediate in-game user resources that may be used to purchase or enable in-game resources based on the result of the wager of game world credits; and the game world server, connected to the processing device via a network and connected to a real world server via a communication link, constructed to:

continuously monitor the processing device for the signal including the trigger of the wager of game world credits triggered by the player's action during the player's skillful play of the entertainment game;

receive, from the processing device, the signal including the trigger of the wager of game world credits triggered by the player's action during the player's skillful play of the entertainment game;

determine whether to trigger the wager based on the signal including the trigger of the wager of game world credits triggered by the player's action during the player's skillful play of the entertainment game;

communicate, to the real world server, the signal including the request for the resolution of the wager of game world credits triggered by the player's action during the player's skillful play of the entertainment game;

receive, from the real world server, the signal including the result of the wager of game world credits triggered by the player's action during the player's skillful play of the entertainment game;

calculate the amount of intermediate in-game user resources that may be used to purchase or enable in-game resources based on the result of the wager of game world credits;

receive, from the processing device, the signal including a portion of the game history information;

store the received portion of the game history information in a memory of the game world server;

receive a request to validate the game history;

communicate, to the processing device, the signal including the request for the game history information in response to receiving the request to validate the game history;

receive, from the processing device, the signal including the game history information;

retrieve the portion of the game history information in the memory of the game world server;

verify the game history information received from the processing device based upon the retrieved at least a portion of the game history information; and communicate, to the processing device, the signal including the result of the wager of game world credits triggered by the player's action during the player's skillful play of the entertainment game and the amount of intermediate in-game user resources when the game history information is verified, and cancel a player account when the game history is unverifiable.

10. The gaming system of claim 9, wherein the game world server is further constructed to:

receive, from the processing device, a signal including the entertainment game information;

detect a triggering event in the entertainment game information; and communicate, to the processing device, a signal including the request to obtain game history information.

11. The gaming system of claim 9, wherein the game world server is further constructed to:

receive, from the real world server, a signal including the gambling game information;

detect a triggering event in the gambling game information; and communicate, to the processing device, a signal including a request for game history information.

12. The gaming system of claim 9, wherein the game history information is a game history record including a header and a captured screen image of a user interface provided by the processing device during the entertainment game.

13. The gaming system of claim 12, wherein the processing device is further constructed to:

capture a screen image from a user interface;

generate image information from the captured screen wherein the image information uniquely identifies the captured screen image;

insert the image information into the header for the game history record; and generate the game history record including the header and the captured screen image.

14. The gaming system of claim 13, wherein the portion of the game history information is the header of the game history record.

15. The gaming system of claim 14, wherein the processing device is further constructed to apply a hash function to the captured screen image to generate a hash that is used as the image information.

16. The gaming system of claim 15, wherein the game world server is further constructed to:

apply the hash function to the captured screen image in the game history record provided by the processing device in response to a request to generate a verification hash;

compare the hash in the header stored to the verification hash; and verify the game history in response to a matching of the verification hash and the hash in the header stored.

17. A gaming system for providing a gambling hybrid game that includes an entertainment game and a gambling game, comprising:

a real world server constructed to:

receive, from a game world server, a signal including a request for a resolution of a wager of game world credits triggered by a player's action during the player's skillful play of the entertainment game;

determine a result of the wager of game world credits triggered by the player's action during the player's skillful play of the entertainment game using a random number generator and generate gambling game information; and communicate, to the game world server, a signal including the result of the wager of game world credits triggered by the player's action during the player's skillful play of the entertainment game; and the game world server, connected to a processing device via a network and connected to the real world server via a communication link, constructed to:

continuously monitor the processing device for a signal including a trigger of the wager of game world credits triggered by the player's action during the player's skillful play of the entertainment game;

receive, from the processing device, the signal including the trigger of the wager of game world credits triggered by the player's action during the player's skillful play of the entertainment game;

determine whether to trigger the wager based on the signal including the trigger of the wager of game world credits triggered by the player's action during the player's skillful play of the entertainment game;

communicate, to the real world server, the signal including the request for the resolution of the wager of game world credits triggered by the player's action during the player's skillful play of the entertainment game;

receive, from the real world server, the signal including the result of the wager of game world credits triggered by the player's action during the player's skillful play of the entertainment game;

calculate an amount of intermediate in-game user resources that may be used to purchase or enable in-game resources based on the result of the wager of game world credits;

receive, from the processing device, a signal including a portion of a game history information;

store the received portion of the game history information in a memory of the game world server;

receive a request to validate the game history;

communicate, to the processing device, a signal including the request for the game history information in response to receiving the request to validate the game history;

receive, from the processing device, a signal including the game history information;

retrieve the portion of the game history information in the memory of the game world server;

verify the game history information received from the processing device based upon the retrieved at least a portion of the game history information; and communicate, to the processing device, the signal including the result of the wager of game world credits triggered by the player's action during the player's skillful play of the entertainment game and the amount of intermediate in-game user resources when the game history information is verified, and cancel a player account when the game history is unverifiable.

18. The gaming system of claim 17, wherein the game world server is further constructed to:

receive, from the processing device, a signal including an entertainment game information;

detect a triggering event in the entertainment game information; and communicate, to the processing device, a signal including the request to obtain game history information.

19. The gaming system of claim 17, wherein the game world server is further constructed to:

receive, from the real world server, a signal including the gambling game information;

detect a triggering event in the gambling game information; and communicate, to the processing device, a signal including a request for game history information.

20. The gaming system of claim 17, wherein the game history information is a game history record including a header and a captured screen image of a user interface provided by the processing device during the entertainment game.

21. The gaming system of claim 20, wherein the processing device is further constructed to:

capture a screen image from a user interface;

generate image information from the captured screen wherein the image information uniquely identifies the captured screen image;

insert the image information into the header for the game history record; and generate the game history record including the header and the captured screen image.

22. The gaming system of claim 21, wherein the portion of the game history information is the header of the game history record.

23. The gaming system of claim 22, wherein the processing device is further constructed to apply a hash function to the captured screen image to generate a hash that is used as the image information.

24. The gaming system of claim 23, wherein the game world server is further constructed to:

apply the hash function to the captured screen image in the game history record provided by the processing device in response to a request to generate a verification hash;

compare the hash in the header stored to the verification hash; and verify the game history in response to a matching of the verification hash and the hash in the header stored.

* * * * *